US010534291B2

(12) United States Patent
Iwata et al.

(10) Patent No.: US 10,534,291 B2
(45) Date of Patent: Jan. 14, 2020

(54) IMAGE FORMING SYSTEM WITH DEVELOPER RETAINER

(71) Applicant: HEWLETT-PACKARD DEVELOPMENT COMPANY, L.P., Spring, TX (US)

(72) Inventors: Naoya Iwata, Yokohama (JP); Satoshi Muramatsu, Yokohama (JP); Tadao Mori, Yokohama (JP)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/224,201

(22) Filed: Dec. 18, 2018

(65) Prior Publication Data

US 2019/0129332 A1 May 2, 2019

(30) Foreign Application Priority Data

Oct. 26, 2017 (JP) ..... 2017-207268
Jul. 18, 2018 (JP) ..... 2018-135244

(51) Int. Cl.
*G03G 15/08* (2006.01)

(52) U.S. Cl.
CPC ..... *G03G 15/0881* (2013.01); *G03G 15/0815* (2013.01); *G03G 15/0865* (2013.01)

(58) Field of Classification Search
CPC ..... G03G 21/206; G03G 15/0898; G03G 15/0815
USPC ..... 399/273, 283
See application file for complete search history.

(56) References Cited

U.S. PATENT DOCUMENTS 4,592,653 A * 6/1986 Ikeda ..... G03G 15/0898 399/103
4,792,831 A * 12/1988 Takeda ..... G03G 15/0898 399/105
5,057,871 A * 10/1991 Hirose ..... G03G 15/0815 399/283
5,164,773 A * 11/1992 Nishio ..... G03G 15/0812 399/283
5,963,768 A * 10/1999 Rhee ..... G03G 15/0815 399/283
6,347,208 B1 * 2/2002 Yamamoto ..... G03G 15/0815 399/281

(Continued)

FOREIGN PATENT DOCUMENTS

JP 61132968 A * 6/1986 ..... G03G 15/0898
JP 5265329 A 10/1993

(Continued)

OTHER PUBLICATIONS

English translation of JP-61132968-A description (Year: 1986).*

*Primary Examiner* — Walter L Lindsay, Jr.
*Assistant Examiner* — Arlene Heredia
(74) *Attorney, Agent, or Firm* — Staas & Halsey LLP

(57) ABSTRACT

An image forming system includes an image carrier to rotate, a developer carrier to rotate, a container to contain the developer carrier, and a developer retainer separated from the rotatable developer carrier by a first gap of closest proximity, separated from the rotatable image carrier by a second gap of closest proximity, and separated from the container by a third gap of closest proximity. The first gap is less than the second gap and the third gap.

15 Claims, 39 Drawing Sheets

(56) References Cited

U.S. PATENT DOCUMENTS

| | | | | |
|---|---|---|---|---|
| 7,221,892 | B2 * | 5/2007 | Sato | G03G 15/0808 399/279 |
| 7,315,717 | B2 * | 1/2008 | Mizuta | G03G 15/0898 399/119 |
| 7,346,296 | B2 * | 3/2008 | Lee | G03G 15/0898 399/167 |
| 7,577,387 | B2 * | 8/2009 | Suzuki | G03G 15/0815 399/254 |
| 7,792,465 | B2 * | 9/2010 | Kubo | G03G 15/0898 399/254 |
| 8,213,843 | B2 * | 7/2012 | Ohashi | G03G 15/0815 399/120 |
| 8,923,723 | B2 * | 12/2014 | Hirakawa | G03G 15/0898 399/98 |
| 9,195,168 | B2 | 11/2015 | Ishii et al. | |
| 9,804,531 | B2 | 10/2017 | Fujimori et al. | |
| 2009/0028612 | A1 * | 1/2009 | Fujimori | G03G 15/0942 399/279 |
| 2017/0212450 | A1 * | 7/2017 | Shishikura | G03G 15/0881 |
| 2019/0018336 | A1 * | 1/2019 | Ogasawara | G03G 15/0225 |

FOREIGN PATENT DOCUMENTS

| | | | |
|---|---|---|---|
| JP | 20140178661 | A | 9/2014 |
| JP | 20180031862 | A | 3/2018 |

* cited by examiner

IMAGE FORMING SYSTEM WITH DEVELOPER RETAINER

CROSS REFERENCE TO RELATED APPLICATIONS

This application claims the priority benefit of Japan Patent Application No. 2017-207268 filed on Oct. 26, 2017, and of Japan Patent Application No. 2018-135244 filed on Jul. 18, 2018, each of which are incorporated by reference herein in their entirety.

BACKGROUND

A developing device has a flow passage forming member extending in a rotation direction of a development sleeve of a toner delivering mechanism between the development sleeve and an inner wall of a main body of the developing device. In addition, an inlet of an intake flow passage portion provided between the flow passage forming member and the development sleeve and an outlet of a discharge flow passage portion provided between the flow passage forming member and the inner wall of the main body of the developing device are adjacent to each other. Consequently, an air pressure increase inside the developing device body is suppressed, and toner scattering out of the main body of the developing device is suppressed.

DETAILED DESCRIPTION

Figure 1:
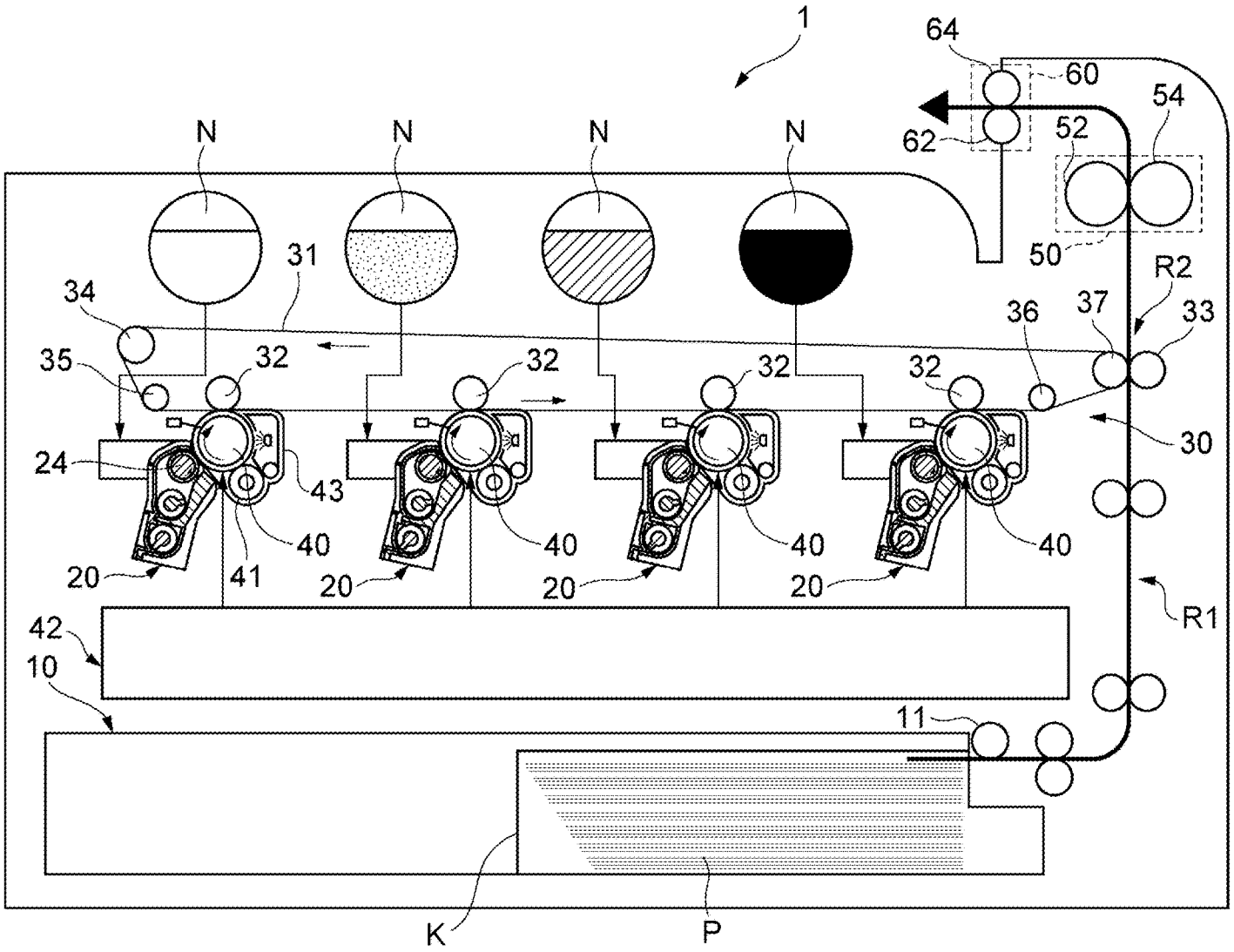
FIG. 1 is a schematic diagram illustrating an example image forming device.

Hereinafter, an example image forming system will be described with reference to the accompanying drawings. In the following description, with reference to the drawings, the same reference numbers are assigned to the same components or to similar components having the same function, and overlapping description is omitted. The image forming system may be an image forming device such as a printer or a fixing device used in the image forming device and the like. Note that, in the description of the drawings, like reference numerals denote like elements, and they will not be described repeatedly.

FIG. 1 is a schematic diagram illustrating an example image forming device 1. The image forming device 1 of FIG. 1 is a device for forming a color image using respective colors of magenta, yellow, cyan, and black. The image forming device 1 includes a feeding device 10 configured to feed a sheet P as a recording medium, a developing device 20 configured to develop an electrostatic latent image, a transfer device 30 configured to secondarily transfer a toner image onto the sheet P, an image carrier 40 having a surface (peripheral surface) on which the electrostatic latent image is formed, a fixing device 50 configured to fix the toner image on the sheet P, and a discharge device 60 configured to discharge the sheet P.

The feeding device 10 feeds a sheet P as a recording medium for forming an image on a feeding path R1. The sheet P is stacked and contained in a cassette K and is picked up and fed by a feeding roller 11. The feeding device 10 feeds the sheet P such that the sheet P arrives at a transfer nip portion R2 through the feeding path R1 at a timing where a toner image transferred to the sheet P arrives at the transfer nip portion R2.

Four developing devices 20 are provided for respective colors. Each developing device 20 has a developer carrier 24 that carries the toner to the image carrier 40. In the developing device 20, a two-component developer containing a toner and a carrier is used as the developer. For example, in the developing device 20, the toner and the carrier are adjusted to have a desired mixing ratio, and are further mixed and stirred to uniformly disperse the toner, so that the developer is adjusted to an optimum charge amount. This developer is borne on the developer carrier 24. In addition, as the developer carrier 24 is rotated, and the developer is fed to a region facing the image carrier 40, the toner contained in the developer borne on the developer carrier 24 moves to the electrostatic latent image formed on the peripheral surface of the image carrier 40 to develop the electrostatic latent image.

The transfer device 30 feeds the sheet P to the transfer nip portion R2 where the toner image formed by the developing device 20 is secondarily transferred to the sheet P. The transfer device 30 includes a transfer belt 31 to which the toner image is primarily transferred from the image carrier 40, suspension rollers 34, 35, 36, and 37 configured to suspend the transfer belt 31, a primary transfer roller 32 configured to nip the transfer belt 31 with the image carrier 40, and a secondary transfer roller 33 configured to nip the transfer belt 31 with the suspension roller 37.

The transfer belt 31 is an endless belt looped around the suspension rollers 34, 35, 36, and 37. The suspension rollers 34, 35, 36, and 37 are rollers rotatable around respective axial lines. The suspension roller 37 is a driving roller for rotationally driving the transfer belt 31 around the axial line. The suspension rollers 34, 35, and 36 are follower rollers that rotate to follow the rotational driving of the suspension roller 37. The primary transfer roller 32 is provided to press the image carrier 40 from the inner peripheral side of the transfer belt 31. The secondary transfer roller 33 is arranged in parallel with the suspension roller 37 by nipping the transfer belt 31 and is provided to press the suspension roller 37 from the outer peripheral side of the transfer belt 31. Consequently, the secondary transfer roller 33 forms the transfer nip portion R2 with the transfer belt 31.

The image carrier 40 is also called an electrostatic latent image carrier, a photosensitive drum, or the like. Four image carriers 40 are provided for respective colors. Each image carrier 40 is provided along a movement direction of the transfer belt 31. The developing device 20, the charging roller 41, the exposure unit 42, and the cleaning unit 43 are provided on the periphery of the image carrier 40.

The charging roller 41 is a charging means for uniformly charging the surface of the image carrier 40 at a predetermined electric potential. The charging roller 41 moves to follow rotation of the image carrier 40. The exposure unit 42 exposes the surface of the image carrier 40 charged by the charging roller 41 depending on an image to be formed on the sheet P. Consequently, an electric potential on a part of the surface of the image carrier 40 exposed by the exposure unit 42 changes to form an electrostatic latent image. The four developing devices 20 develop the electrostatic latent images formed on the image carriers 40 by the toner supplied from the toner reservoirs N provided to face the respective developing devices 20 to create a toner image. Magenta, yellow, cyan, and black toners are filled in the respective toner reservoirs N. The cleaning unit 43 recovers the toner remaining on the image carrier 40 after the primary transfer of the toner image formed on the image carrier 40 to the transfer belt 31.

The fixing device 50 attaches and fixes the toner image secondarily transferred from the transfer belt 31 to the sheet P onto the sheet P by passing the sheet P through the fixation nip portion with heat and pressure. The fixing device 50 includes a heating roller 52 configured to heat the sheet P and a pressing roller 54 configured to rotationally drive the heating roller 52 with pressure. The heating roller 52 and the pressing roller 54 are formed in a cylindrical shape, and the heating roller 52 internally has a heat source such as a halogen lamp. The fixation nip portion as a contact region is provided between the heating roller 52 and the pressing roller 54 to melt and fix the toner image onto the sheet P as the sheet P passes through the fixation nip portion. The discharge device 60 has discharge rollers 62 and 64 for discharging the sheet P on which the toner image is fixed by the fixing device 50 to the outside.

An example print process using the example image forming device 1 will be described. As an image signal of a recording target image is input to the image forming device 1, a control unit of the image forming device 1 rotates the feeding roller 11 to pick up and feed the sheet P stacked on the cassette K. In addition, on the basis of the received image signal, the charging roller 41 uniformly charges the surface of the image carrier 40 at a predetermined electric potential (charging process). Then, an electrostatic latent image is formed by irradiating laser light onto the surface of the image carrier 40 using the exposure unit 42 (exposure process).

The developing device 20 develops the electrostatic latent image to form a toner image (developing process). The toner image formed in this manner is primarily transferred from the image carrier 40 to the transfer belt 31 in a region where the image carrier 40 and the transfer belt 31 face each other (transfer process). The toner images formed on the four image carriers 40 are sequentially superimposed on the transfer belt 31 to form a composite toner image. In addition, the composite toner image is secondarily transferred onto the sheet P fed from the feeding device 10 in the transfer nip portion R2 where the suspension roller 37 and the secondary transfer roller 33 oppose each other.

The sheet P subjected to the secondary transfer of the composite toner image is fed to the fixing device 50. In addition, the fixing device 50 heats and presses the sheet P between the heating roller 52 and the pressing roller 54 when the sheet P passes through the fixation nip portion, so that the composite toner image is molten and fixed to the sheet P (fixing process). Then, the sheet P is discharged to the outside of the image forming device 1 through the discharge rollers 62 and 64.

Figure 2:
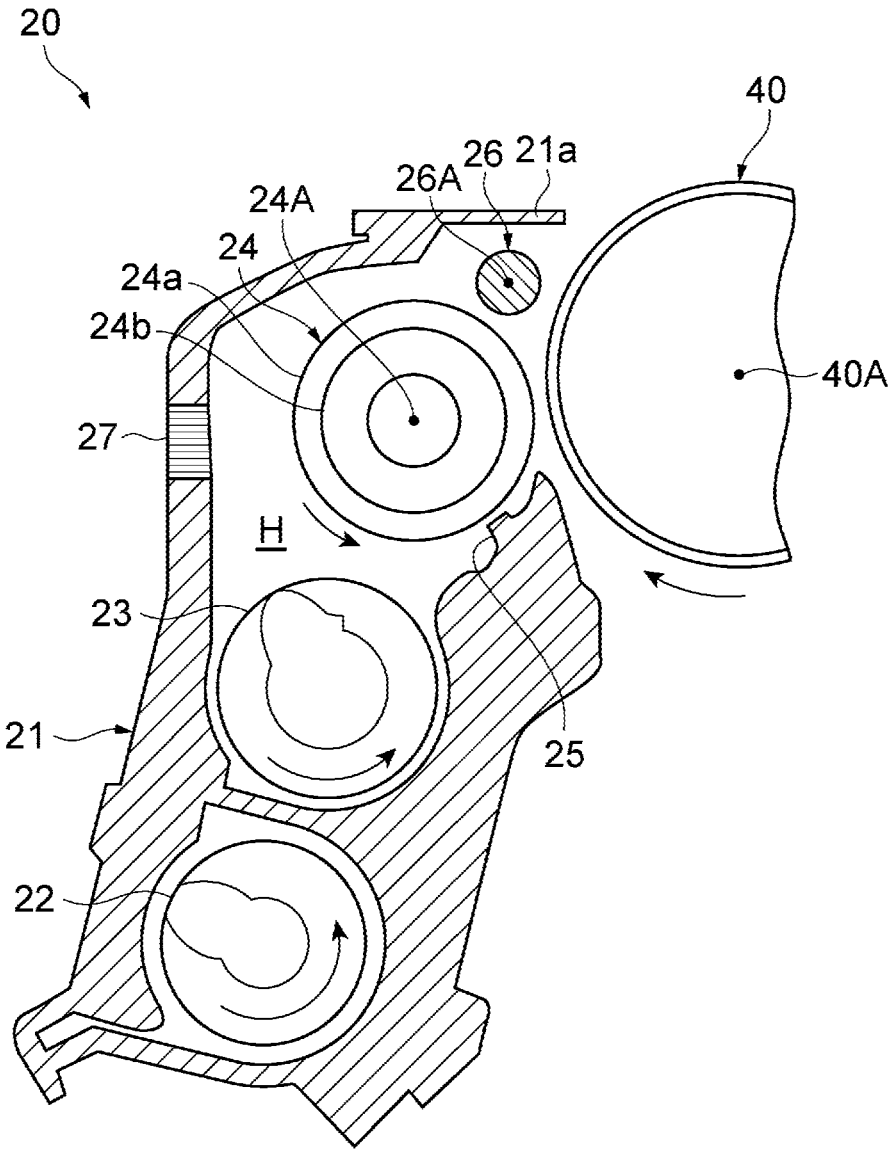
FIG. 2 is a schematic cross-sectional view illustrating an example developing device.

FIG. 2 is a schematic cross-sectional view illustrating an example developing device 20. The example developing device 20 includes a rotatable image carrier 40, a container 21, a first stirring/feeding member 22, a second stirring/feeding member 23, a rotatable developer carrier 24, a carry amount restrictor 25, and a developer retainer (developer retention member) 26.

An electrostatic latent image may be formed on a surface of the image carrier 40. For example, the image carrier 40 may be supported rotatably with respect to the container 21 and rotationally driven by a driving source (not illustrated) such as a motor. The image carrier 40 may be formed, for example, in a cylindrical shape.

The container 21 may contain a developer containing the toner and the carrier. That is, the container 21 may form a developer storage H for storing the developer containing the toner and the carrier. The container 21 may house a first stirring/feeding member 22, a second stirring/feeding member 23, a developer carrier 24, a carry amount restrictor 25, and a developer retainer 26. The container 21 may have an opening at a position where the developer carrier 24 and the image carrier 40 face each other, so that the toner inside the developer storage H may be supplied to the image carrier 40 through this opening. The container 21 may have a filter 27 provided in a through-hole formed in the container 21 to ventilate the container 21 between the inside and the outside and obstruct passing of the developer. The container 21 may have a developer outlet (not illustrated) for discharging a used developer from the developer storage H.

The first stirring/feeding member 22 and the second stirring/feeding member 23 may stir a magnetic carrier and a non-magnetic toner of the developer inside the developer storage H to frictionally electrify the carrier and the toner. In addition, the first stirring/feeding member 22 and the second stirring/feeding member 23 may feed the developer while stirring the developer inside the developer storage H.

The developer carrier 24 may be arranged to face the image carrier 40 and form a gap with the image carrier 40, and to rotate while carrying the developer contained in the container 21 on its surface. The developer carrier 24 may be formed, for example, in a cylindrical shape, semi-cylindrical shape, or the like. The developer carrier 24 may be arranged such that the axial line 24A of the developer carrier 24 and the axial line 40A of the image carrier 40 are in parallel with each other, and an interval between the developer carrier 24 and the image carrier 40 are constant in the axial line 24A direction (axial line 40A direction). The developer carrier 24 carries the developer stirred by the first stirring/feeding member 22 and the second stirring/feeding member 23 on its surface. The developer carrier 24 feeds the borne developer to the development region to develop the electrostatic latent image of the image carrier 40. The development region may be a region where the developer carrier 24 and the image carrier 40 face each other. The development region may be a region where the developer carrier 24 and the image carrier 40 are closest to each other.

The developer carrier 24 may have a development sleeve 24*a* configured to form a surface layer of the developer carrier 24 and a magnet 24*b* disposed inside the development sleeve 24*a*. The development sleeve 24*a* may include a cylindrical member formed of non-magnetic metal. The development sleeve 24*a* may be rotatable with respect to the axial line 24A. For example, the development sleeve 24*a* may be rotatably supported by the magnet 24*b* and rotationally driven by a driving source (not illustrated) such as a motor. The magnet 24*b* may be fixed to the container 21 and have a plurality of magnetic poles. The developer may be borne on a surface of the development sleeve 24*a* by virtue of a magnetic force of the magnet 24*b*. The developer carrier 24 may feed the developer in a rotation direction of the development sleeve 24*a* as the development sleeve 24*a* rotates.

A developer napping may be formed on the development sleeve 24*a* by virtue of a magnetic force of each magnetic pole of the magnet 24*b*. The developer carrier 24 causes the developer napping formed by the magnetic pole to contact or approach the electrostatic latent image of the image carrier 40 in the development region. Consequently, the toner contained in the developer borne on the developer carrier 24 may move to the electrostatic latent image formed on the peripheral surface of the image carrier 40 so as to develop the electrostatic latent image.

The carry amount restrictor 25 may restrict the amount of the developer borne on the developer carrier 24. The carry amount restrictor 25 may be provided in an upstream side of the development region relative to a rotation direction of the development sleeve 24*a*. The carry amount restrictor 25 may be positioned under the axial line 24A of the developer carrier 24. The carry amount restrictor 25 may form a predetermined gap with the development sleeve 24*a*. Accordingly, the carry amount restrictor 25 restricts a layer thickness of the developer borne on the peripheral surface of the development sleeve 24*a* as the development sleeve 24*a* rotates. Consequently, the layer thickness of the developer is smoothened to form a uniform thickness layer. The feeding amount of the developer of the developer carrier 24 fed to the development region can be controlled by adjusting the interval between the carry amount restrictor 25 and the development sleeve 24*a*.

In the example developing device 20, the developer retainer 26 faces (is adjacent to) the developer carrier 24, the image carrier 40, and the container 21 so as to form gaps between the developer carrier 24, the image carrier 40, and the container 21. The developer retainer 26 may form an air circulation path between the developer carrier 24, the image carrier 40, and the container 21 to return the developer discharged from the container 21 back to the container 21. The developer retainer 26 may face, for example, a casing top wall 21*a* positioned over the developer retainer 26 in the container 21. A surface of the casing top that is adjacent to the developer retainer 26 wall 21*a* may be formed in a planar shape. The developer retainer 26 may be formed in a rod shape and extend in parallel with the axial line 24A of the developer carrier 24.

Figure 3:
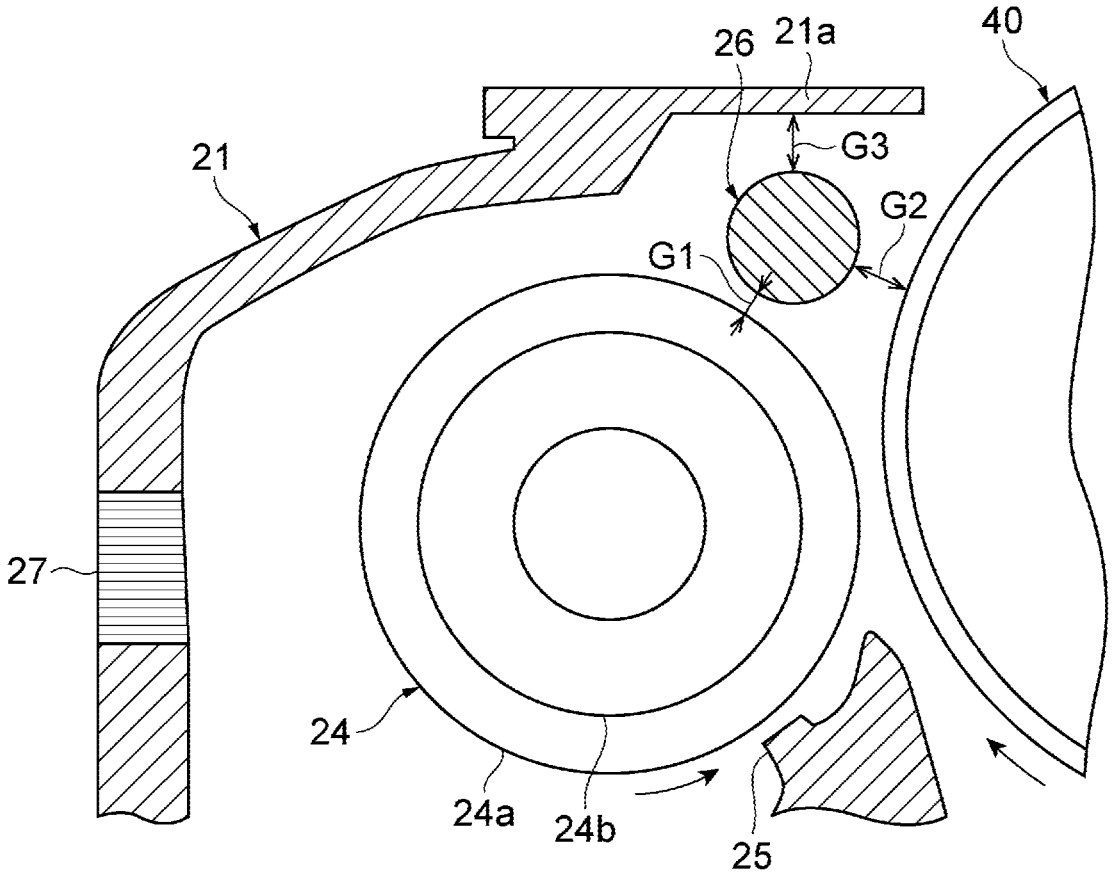
FIG. 3 is a schematic cross-sectional view of components of an example developing device.

As illustrated in FIG. 3, the developer retainer 26 may be separated from (or spaced apart from) the rotatable developer carrier 24 by a closest first gap G1 (or first gap G1). The developer retainer 26 may further be separated from (or spaced apart from) the rotatable image carrier 40 by a closest second gap G2 (or second gap G2). The developer retainer 26 is separated from (or spaced apart from) the container 21 by a closest third gap G3 (or third gap G3). The third gap G3 may be formed between the casing top wall 21*a* of the container 21 and the developer retainer 26. The third gap G3 may be directed to the image carrier 40. For example, the third gap G3 may be open (or in fluid communication with) the image carrier 40. In some examples, one or more members may be arranged in each of the first, second, and third gaps G1, G2, and G3. In the present example, the first gap G1 refers to a gap or space between the developer carrier 24 and the developer retainer 26 and also represents a distance of the gap, that is, the closest distance between the developer carrier 24 and the developer retainer 26. The second gap G2 refers to a gap or space between the image carrier 40 and the developer retainer 26 and also represents a distance of the gap, that is, the closest distance between the image carrier 40 and the developer retainer 26. The third gap G3 refers to a gap or space between the container 21 and the developer retainer 26 and also represents a distance of the gap, that is, the closest distance between the container 21 and the developer retainer 26.

The developer retainer 26 may be formed of, for example, a non-magnetic material. The non-magnetic material of the developer retainer 26 may include, for example, SUS304, or the like.

The developer retainer 26 may have a variety of shapes, depending on examples. In some examples, the developer retainer 26 may be formed to protrude toward the developer carrier 24 side at the first gap G1. In some examples, the developer retainer 26 may have a circular cross-sectional surface shape until the developer retainer 26 reaches the first gap G1 at least from the third gap G3 via the second gap G2. For example, a cross-section of the developer retainer may have a periphery of which a portion follows a circular shape, where the portion of the periphery extends from the first gap G1, via the second gap G2, to the third gap G3. The developer retainer 26 may be formed, for example, in a cylindrical shape, an elliptical cylindrical shape, a semi-cylindrical shape, and the like.

In a case where the surface of the developer retainer 26 side of the casing top wall 21*a* is formed in a planar shape, it is possible to enlarge a space between the container 21 and the developer retainer 26 from the third gap G3 toward the image carrier 40 by forming the surface of the developer retainer 26, that is adjacent to the casing top wall 21*a* in a protruding surface shape. Hereinafter, it is assumed that the developer retainer 26 is formed in a cylindrical shape by way of example.

The axial line 26A of the developer retainer 26, the axial line 24A of the developer carrier 24, and the axial line 40A of the image carrier 40 may be substantially parallel with one another. An interval (or closest distance) between the developer carrier 24 and the developer retainer 26 may be constant across the entire area in the axial line 24A direction and the axial line 40A direction. An interval (or closest distance) between the image carrier 40 and the developer retainer 26 may be constant across the entire area in the axial line 40A direction and the axial line 24A direction. An interval (or closest distance) between the casing top wall 21*a* of the container 21 and the developer retainer 26 may be constant across the entire area in the axial line 26A direction.

Figure 4:
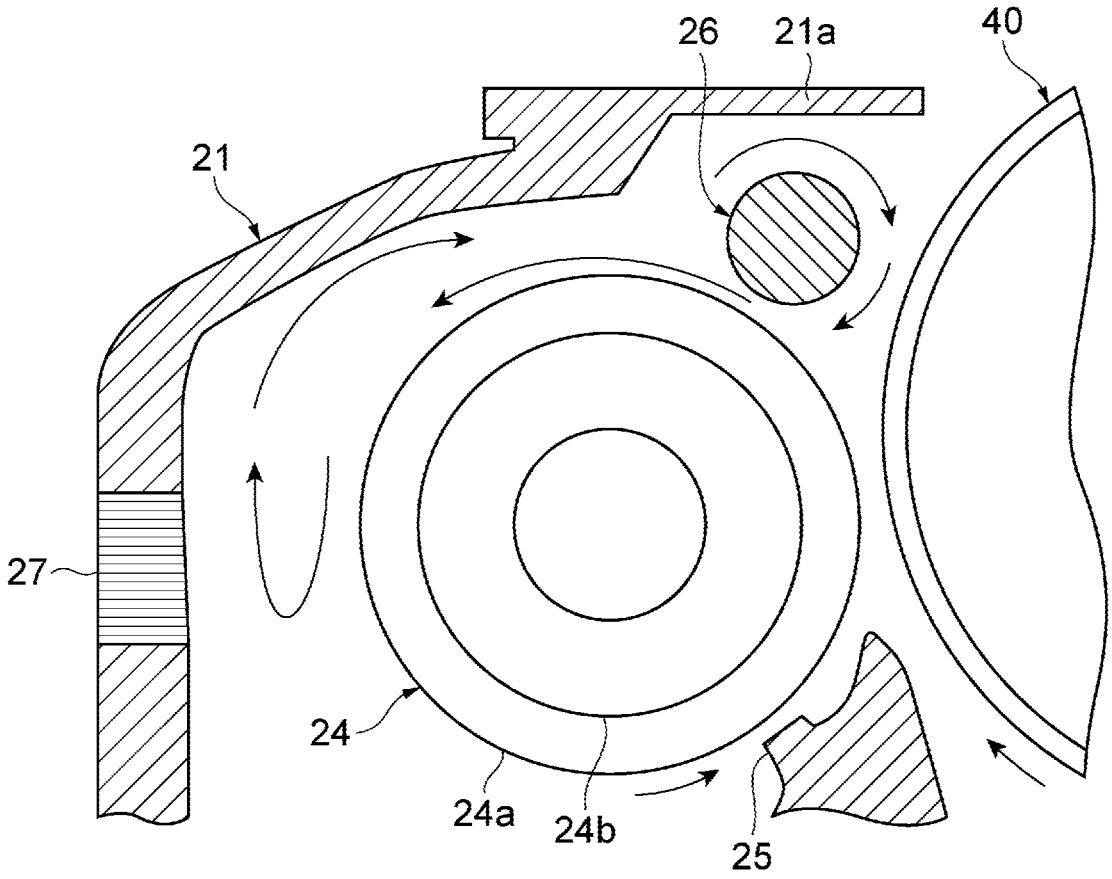
FIG. 4 is a schematic cross-sectional view of components of an example developing device.

As illustrated in FIG. 4 with further reference to FIG. 3, as the development sleeve 24*a* of the developer carrier 24 rotates, the air in the first gap G1 may be input to (or drawn into) the container 21 by the developer napping carried on the surface of the developer carrier 24. The developer input to (or drawn into) the container 21 may be turned back inside the container 21, and discharged from the container 21 through the third gap G3, and may be returned to the first gap G1 through the second gap G2. That is, around the developer retainer 26, a circulation flow of the air flowing along the first gap G1, the inside of the container 21, the third gap G3, and the second gap G2, in this order, may be generated.

The first gap G1 may be less than the second gap G2 and the third gap G3. For example, the first, second, and third gaps G1, G2, and G3 may satisfy the following relationships (1) and (2).

$$\text{first gap G1} < \text{second gap G2} \quad (1)$$

$$\text{first gap G1} < \text{third gap G3} \quad (2)$$

The second gap G2 may be equal to or less than the third gap G3. That is, the second and third gaps G2 and G3 may satisfy the following relationship (3).

$$\text{second gap G2} \leq \text{third gap G3} \quad (3)$$

The first gap G1 may be equal to or greater than 0.5 mm and equal to or less than 1.2 mm. For example, the first gap G1 may be within a range of 0.5 mm to 1.2 mm, inclusive. Accordingly, the first gap G1 between the developer carrier 24 and the developer retainer 26 may satisfy the following relationship (4).

$$0.5\text{ mm} \leq \text{first gap G1} \leq 1.2\text{ mm} \quad (4)$$

The second gap G2 may be greater than 0.5 mm and equal to or less than 2.0 mm. For example, the second gap G2 may be within a range of 0.5 mm to 2 mm, inclusive. Accordingly, the second gap G2 between the image carrier 40 and the developer retainer 26 may satisfy the following relationship (5).

$$0.5\text{ mm} < \text{second gap G2} \leq 2.0\text{ mm} \quad (5)$$

The third gap G3 may be equal to or greater than 1.0 mm. Accordingly, the third gap G3 between the container 21 and the developer retainer 26 may satisfy the relationship (6) further below. In some examples, the third gap G3 may also be equal to or less than 2.5 mm. For example, the third gap G2 may be within a range of 1.0 mm to 2.5 mm, inclusive.

$$1.0\text{ mm} \leq \text{third gap G3} \quad (6)$$

Figure 5:
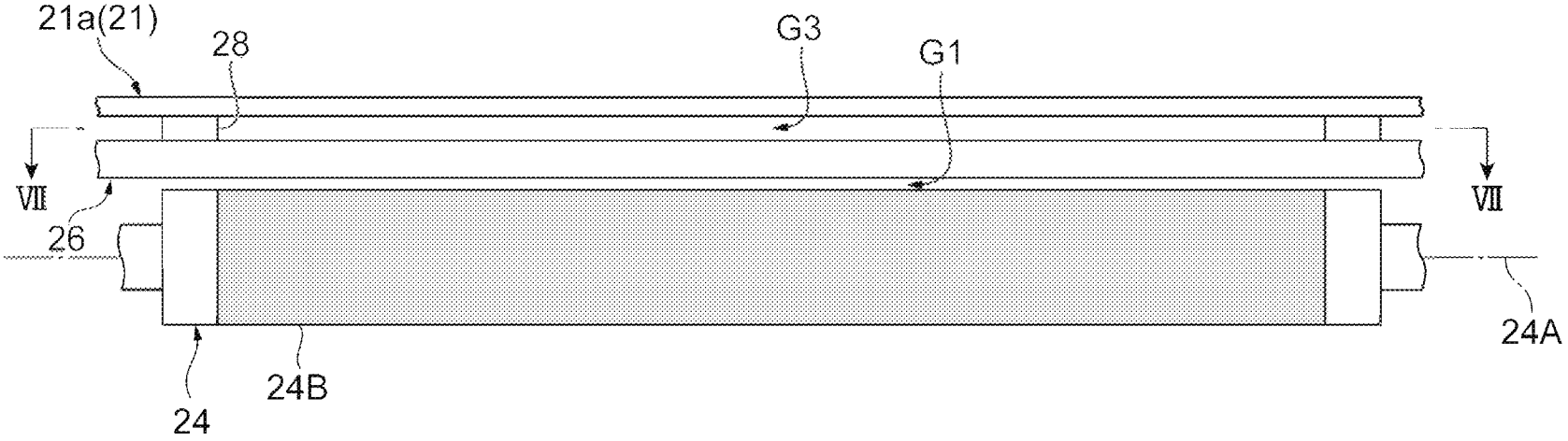
FIG. 5 is a schematic side view of components of an example developing device.

As illustrated in FIG. 5, the developer carrier 24 has a developer carrying region 24B for carrying the developer. The developer carrying region 24B may be a partial region of the developer carrier 24 in the direction of the axial line 24A. The developer carrying region 24B may include, for example, a grooved or roughened region to carry the developer on the surface of the development sleeve 24*a*, a region where the magnet 24*b* is arranged, a combination of these regions, and the like.

An end forming member 28 may be provided between the casing top wall 21*a* of the container 21 and the developer retainer 26. The end forming member 28 may define a length of the third gap G3 in the axial line 24A direction of the developer carrier 24 by blocking the end of the third gap G3 in the axial line 24A direction of the developer carrier 24. Accordingly, it is possible to adjust the length of the third gap G3 in the axial line 24A direction of the developer carrier 24 by positioning the end forming member 28.

Figure 6:
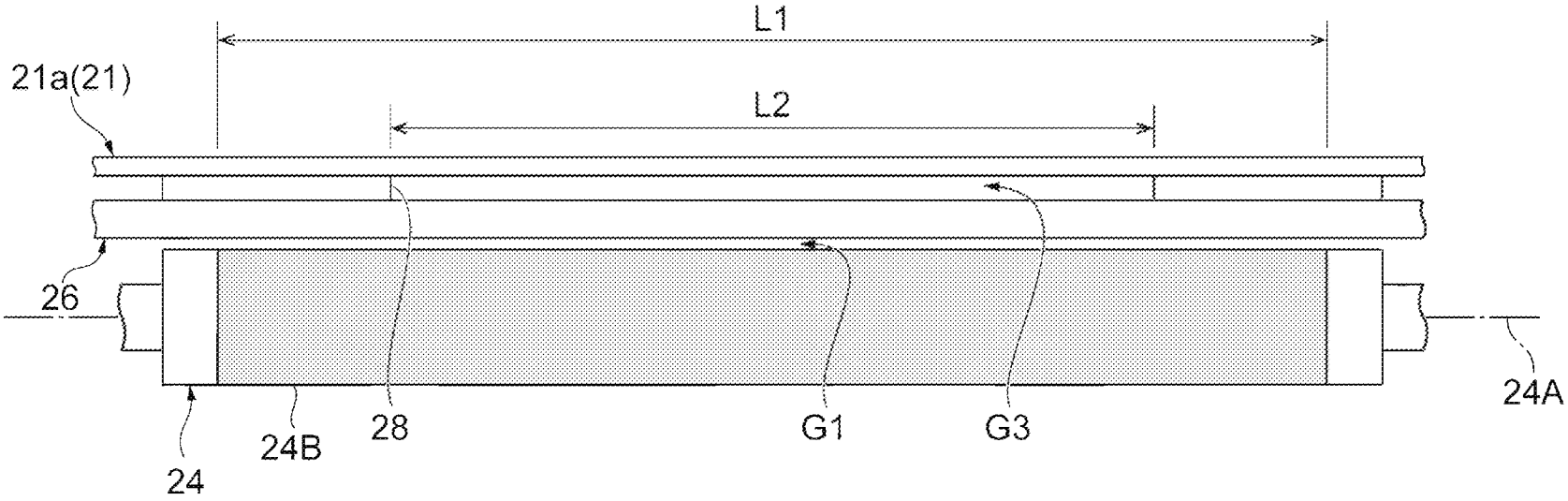
FIG. 6 is another schematic side view of components of an example developing device.

As illustrated in FIG. 6, the length L1 refers to a length of the developer carrying region 24B in the axial line 24A direction of the developer carrier 24, and the length L2 refers to a length of the third gap G3 in the axial line 24A direction of the developer carrier 24. The length L2 may be equal to or less than the length L1. In some examples, the length L2 may be less than the length L1. That is, the lengths L1 and L2 may satisfy the following relationship (7) and/or (8).

$$L1 \geq L2 \quad (7)$$

$$L1 > L2 \quad (8)$$

A difference between the lengths L1 and L2 (L1−L2) may be equal to or greater than 10 mm, and equal to or less than 40 mm. For example, the difference between the lengths L1 and L2 may be within a range of 10 mm to 40 mm, inclusive. Accordingly, the lengths L1 and L2 may satisfy the following relationship (9).

$$10\text{ mm} \leq (L1 - L2) \leq 40\text{ mm} \quad (9)$$

In some examples, where the first gap G1 has a cross-sectional area S1, and the third gap G3 has a cross-sectional area S2, the cross-sectional area S1 may be less than the cross-sectional area S2. That is, the cross-sectional areas S1 and S2 may satisfy the following relationship (10).

$$S1 < S2 \quad (10)$$

The end forming member 28 may include, for example, a rib formed in the container 21, a rib formed in the developer retainer 26, or a member different from the container 21 and the developer retainer 26, and/or the like. In a case where the end forming member 28 is formed from a member different from the container 21 and the developer retainer 26, the end forming member 28 may be formed from, for example, an elastic member. The elastic member may include, for example, an elastically deformable member such as rubber.

Figure 7:
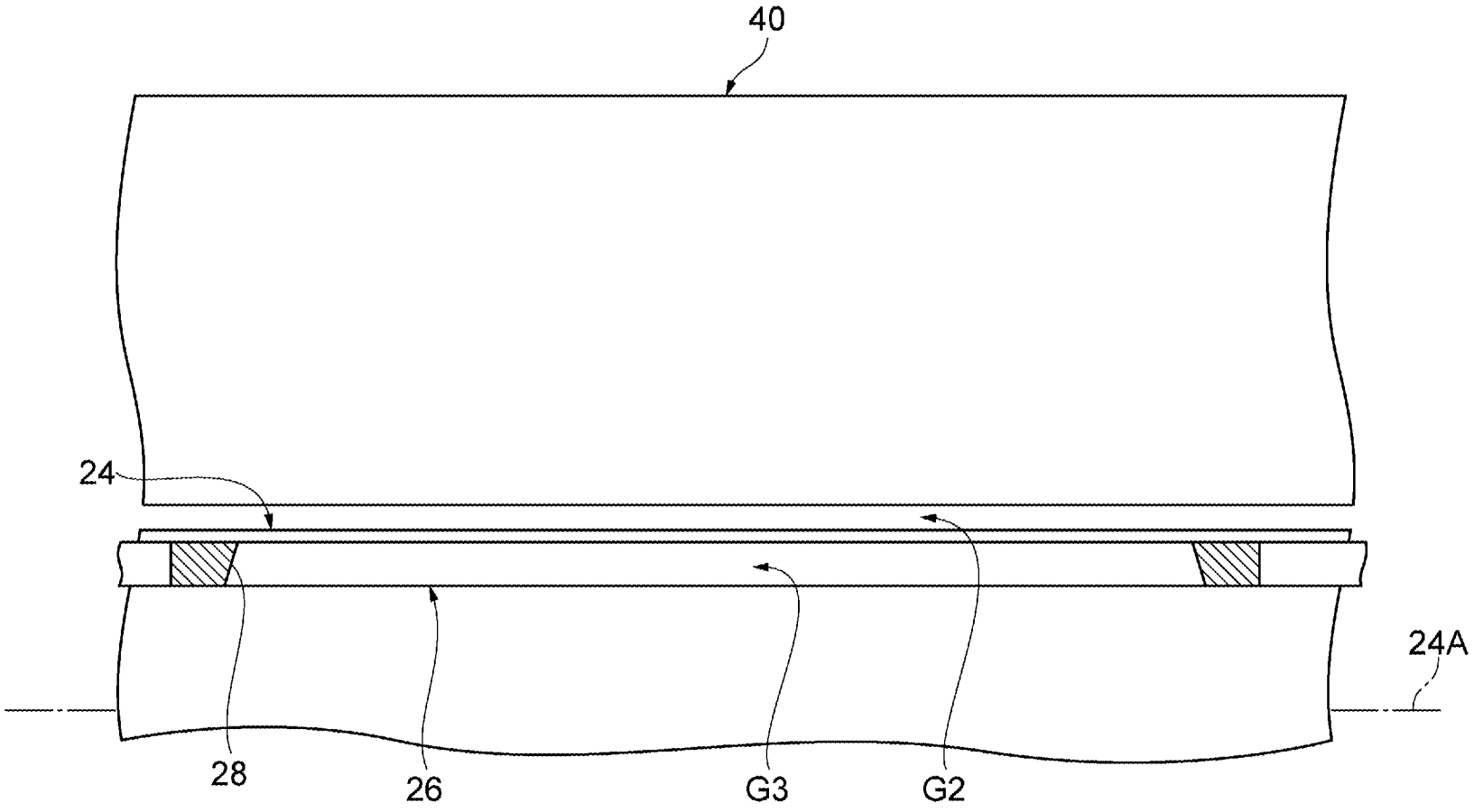
FIG. 7 is a schematic cross-sectional view of the developing device shown in FIG. 5, taken along the line VII-VII.

Meanwhile, the end forming member 28 also acts as a baffle plate for rectifying or adjusting the air flow flowing through the third gap G3 between the container 21 and the developer retainer 26. In this regard, as illustrated in FIG. 7, the air flow flowing through the third gap G3 may be adjusted by narrowing the third gap G3 in the direction of the axial line 24A of the developer carrier 24, toward the image carrier 40 by the end forming member 28. This configuration may be implemented, for example, by providing a pair of end forming members 28 at both ends of the third gap G3 and sloping the inner surfaces in opposite directions to be narrowed toward the image carrier 40.

Here, in a case where an air volume of the air flow flowing through the first gap G1 is equal to an air volume of the air flow flowing through the second and third gaps G2 and G3, a velocity of the air flow may be faster through a narrower one of the first, second, and third gaps G1, G2, and G3. In this example, since the first gap G1 is less than the second and third gaps G2 and G3, the velocity of the air flow flowing through the second and third gaps G2 and G3 is reduced, so that the velocity of the air flow flowing through the first gap G1 can be improved. In addition, the air velocity may be relatively slow in the third gap G3, such that the air velocity increases in order of the third gap G3, the second gap G2, and the first gap G1. For example, the air velocity in the first gap G1 is greater than the air velocity in the second gap G2, and the air velocity in the second gap G2 is greater than the air velocity in the third gap G3. Consequently, it is possible to more reliably recover the developer discharged from the third gap G3 from the first gap G1 to the container 21 by appropriately generating an air flow directed from the third gap G3, to the second gap G2, and to the first gap G1.

In a case where the second gap G2 is equal to or less than the third gap G3, it is possible to appropriately form the air flow flowing from the third gap G3 to the second gap G2.

Meanwhile, the first gap G1 contributes to the amount of air suctioned to the container 21. This suction amount depends on the first gap G1 and the feeding amount of the developer on the development sleeve 24*a* of the developer carrier 24. The feeding amount of the developer on the development sleeve 24*a* will be referred to as a feeding amount DMA. As this suction amount increases, the air discharged from the third gap G3 can be suctioned more easily to the second gap G2.

In this regard, an experiment was performed using the example image forming device 1. In this experiment, the air volume of the air flow flowing through the first gap G1 and the toner scattering amount were measured. The measurement of the air volume of the air flow flowing through the first gap G1 was performed in the following way. An air velocity on the defined cross section was performed using measurement instrument KANOMAX CLIMOMASTER, Model Nos. 6501 and 16543. A product obtained by multiplying this measured air velocity and the cross-sectional area was set as the air volume of the air flow flowing through the first gap G1. The measurement of the toner scattering amount was performed in the following way. A toner deposited on the container 21 by rotating the developer carrier 24 in a stop state of the image carrier 40 was recovered. Then, a weight of the recovered toner was measured. In addition, a weight measurement result per minute was set as the toner scattering amount. The measurement result is shown in FIG. 8.

Figure 8:
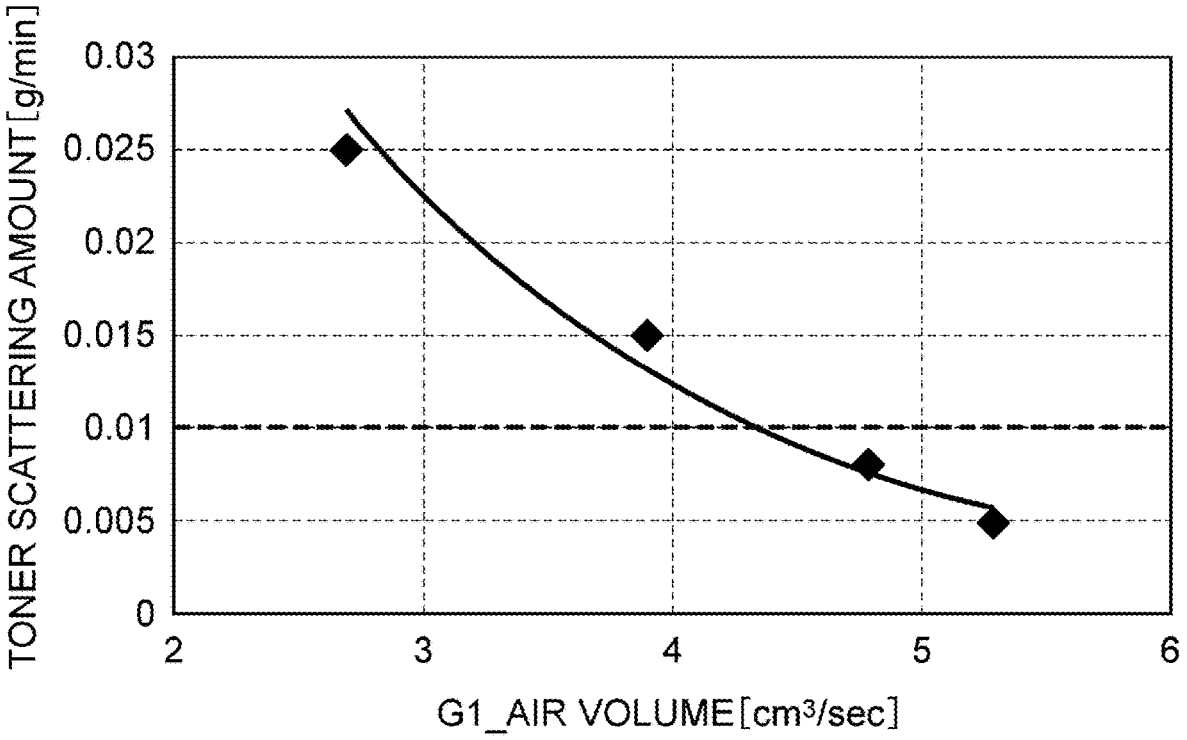
FIG. 8 is a graph showing measurement results.

As illustrated in FIG. 8, when the air volume of the first gap G1 was equal to or greater than 4.5 $cm^3$/sec, the toner scattering amount was equal to or less than 0.01 g/min. The value 0.01 g/min is an example of the target value of the toner scattering amount.

Then, while the feeding amount DMA was constantly maintained at 575 $g/m^2$, an air volume flowing to the first gap G1 and the container 21 was measured. Note that the air volume of the air flowing to the container 21 was substantially equal to the air volume of the air flowing through the first gap G1. The measurement of the input air volume was performed by providing an outlet having a square area of 10 $mm^2$ on the back side of the container 21 and measuring the velocity of the air flowing through this outlet and the cross-sectional area. In addition, a product obtained by multiplying the air velocity and cross-sectional area was set as the input air volume. The measurement results are shown in FIG. 9.

Figure 9:
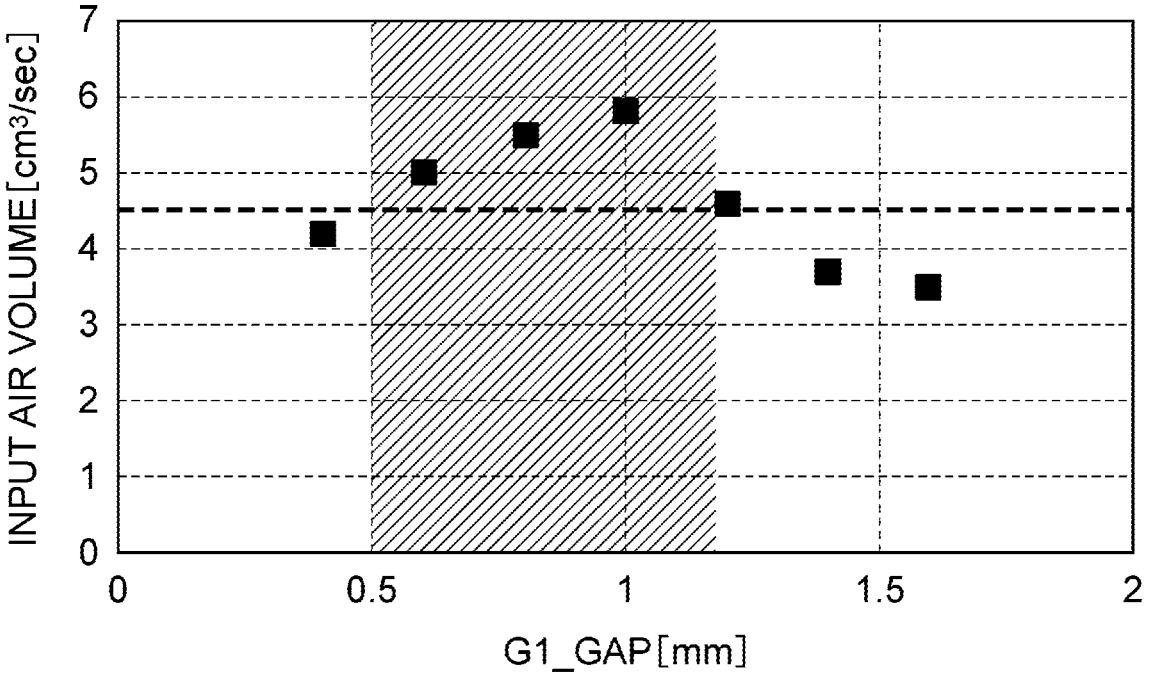
FIG. 9 is a graph showing measurement results.

As illustrated in FIG. 9, when the first gap G1 was equal to or greater than 0.5 mm, the air volume of the first gap G1 was equal to or greater than 4.5 $cm^3$/sec. In addition, when the first gap G1 was equal to or less than 1.2 mm, the air volume of the first gap G1 was equal to or greater than 4.5 $cm^3$/sec. This value 4.5 $cm^3$/sec is an example of the target value of the air volume of the first gap G1.

Based on the aforementioned results, by satisfying the relationship of 0.5 mm≤first gap G1≤1.2 mm, it is possible to suitably set the air volume of the air flow flowing through the first gap G1 and allow the air to be sufficiently suctioned from the first gap G1 to the container 21, in order to suppress toner scattering.

The second gap G2 and the toner scattering amount were measured while the first gap G1 was fixed at 0.5 mm, and the third gap G3 was fixed at 2.5 mm to satisfy the relationship of first gap G1<third gap G3. The measurement results are shown in FIG. 10.

Figure 10:
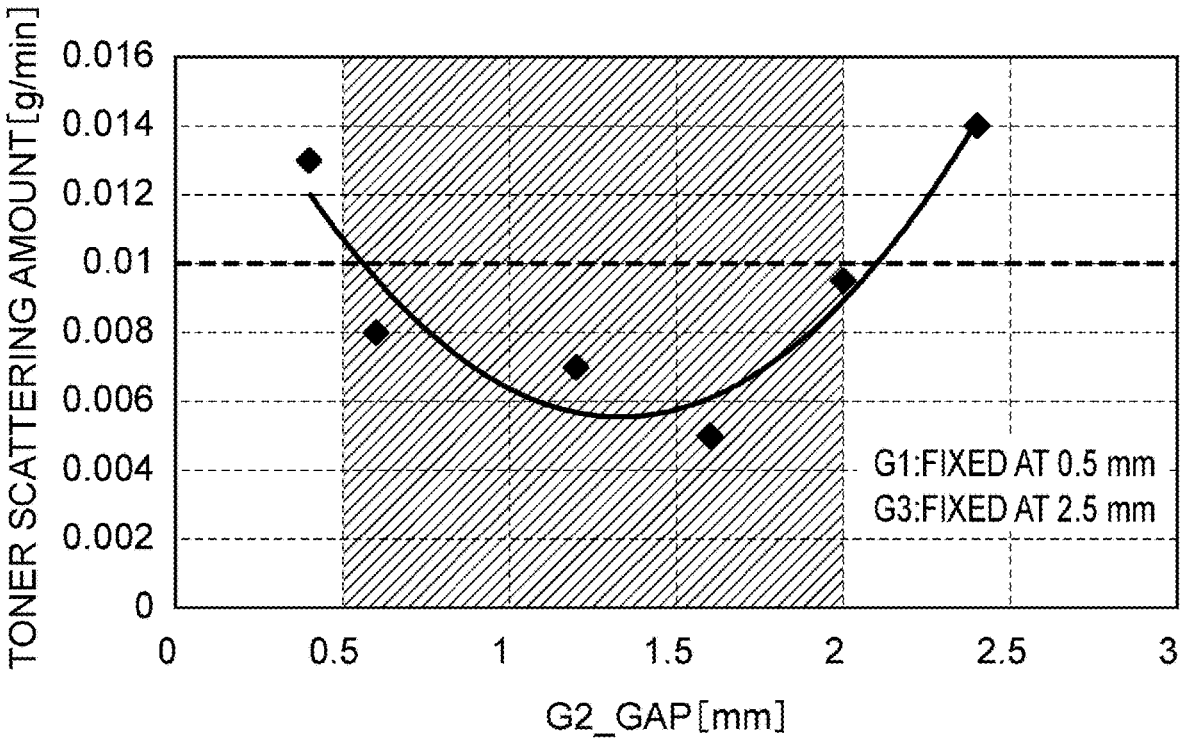
FIG. 10 is a graph showing measurement results.

As illustrated in FIG. 10, when the second gap G2 was greater than 0.5 mm, the toner scattering amount became equal to or less than 0.01 g/min. It is conceived that this is because a pressure loss in the air flow flowing through the second gap G2 is suppressed, and a capability of suctioning the air flow discharged from the third gap G3 to the first gap G1 through the second gap G2 is improved. In addition, when the second gap G2 was set to 2.0 mm, the toner scattering amount was 0.01 g/min. It is conceived that this is because the air flow is suitably formed in the second gap G2. This value 0.01 g/min is an example of the target value of the toner scattering amount.

Based on the aforementioned results, it is possible to suppress a pressure loss in the air flow flowing through the second gap G2 and suitably form the air flow flowing from the second gap G2 to the first gap G1 by satisfying the relationship of 0.5 mm<second gap G2≤2.0 mm, in order to suppress toner scattering.

The third gap G3 and the toner scattering amount were measured while the first gap G1 was fixed at 0.5 mm, and the second gap G2 was fixed at 0.6 mm to satisfy the relationship of first gap G1<second gap G2. The measurement results are shown in FIG. 11.

Figure 11:
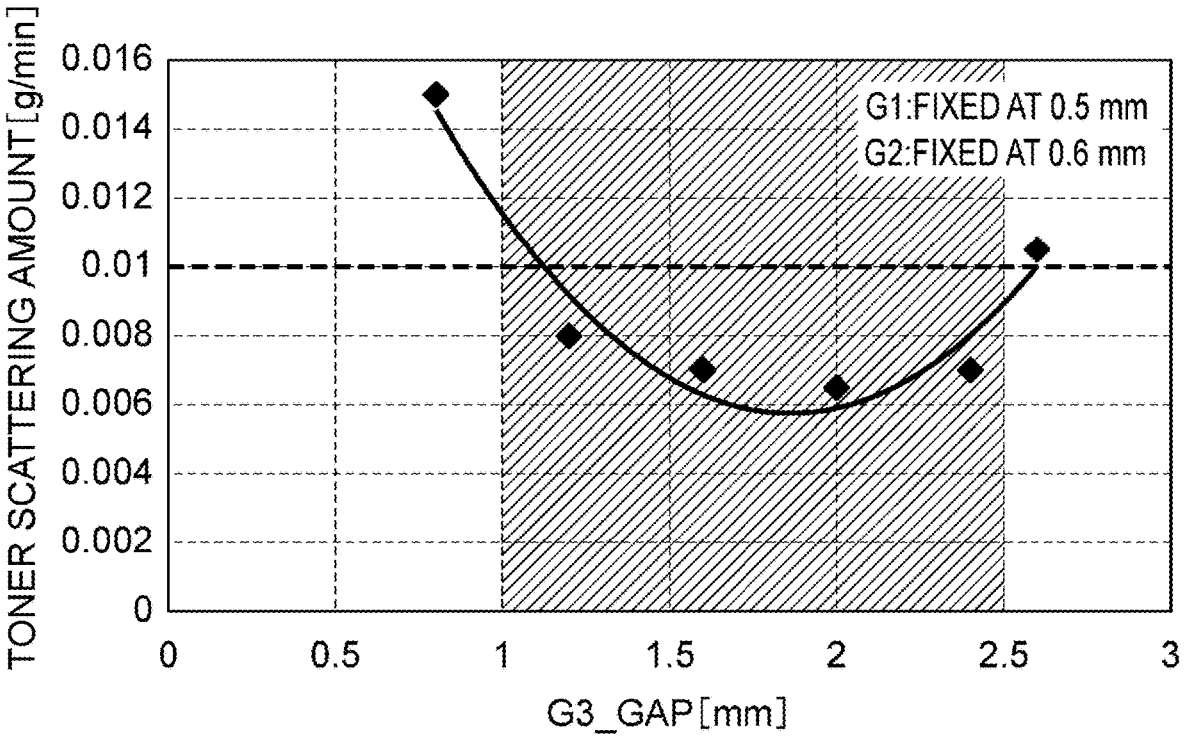
FIG. 11 is a graph showing measurement results.

As illustrated in FIG. 11, when the third gap G3 was equal to or greater than 1.0 mm, the toner scattering amount was equal to or less than 0.01 g/min. It is conceived that this is because the air flow is appropriately formed in the third gap G3, so that most of the air flow passing through the third gap G3 flows to the second gap G2 without interfering with the image carrier 40. This value 0.01 g/min is an example of the target value of the toner scattering amount. Note that, considering a layout relationship of the developing device 20, the third gap G3 may be equal to or less than, for example, 2.5 mm.

Based on the aforementioned results, by satisfying the relationship of 1.0 mm third gap G3, it is possible to appropriately form the air flow in the third gap G3 and flow (or channel) most of the air flow passing through the third gap G3 to the second gap G2 without interfering with the image carrier 40, in order to suppress toner scattering.

In addition, when the space between the container 21 and the developer retainer 26 is enlarged from the third gap G3 toward the image carrier 40, it is possible to reduce the velocity of the air flow passing through the third gap G3.

Consequently, it is possible to flow (or to channel) most of the air flow passing through the third gap G3 to the second gap G2 without interfering with the image carrier 40. Therefore, it is possible to promote circulation of the air flow and allow the air to be efficiently suctioned to the inside of the container 21.

In addition, when the container 21 has a filter 27, it is possible to reduce the air volume of the circulation flow and the internal pressure of the container 21, in order to suppress toner scattering.

The air suction amount to the inside of the container 21 is proportional to the surface area of the developer retainer 26 in the first gap G1. In this example, in a case where the developer retainer 26 has a shape protruding toward the developer carrier 24 in the first gap G1, it is possible to reduce the surface area of the developer retainer 26 in the first gap G1 and reduce the air suction amount to the inside of the container 21.

When the developer retainer 26 is formed of a magnetic material, the carrier floating by the magnetic force of the developer carrier 24 may be attached to the developer retainer 26 so as to vary the first gap G1. In this example, in a case where the developer retainer 26 is formed of a non-magnetic material, it is possible to suppress the carrier from being attached to the developer retainer 26, in order to suppress a variation of the first gap G1.

As described above, due to the developer borne on the developer carrying region 24B of the developer carrier 24, the air flow suctioned from the first gap G1 to the inside of the container 21 is generated, and the air flow suctioned to the container 21 is discharged from the third gap G3 to the outside of the container 21. Since the air flow containing the toner flows more easily in a direction of less resistance (e.g. without any obstacle), the air flow flowing through the third gap G3 flows more easily to both end sides in the axial line 24A direction of the developer carrier 24. When the air flow flowing through the third gap G3 spreads excessively to the axial line 24A direction of the developer carrier 24, toner scattering may increase and may become significant. In this example, since the length L2 of the third gap G3 in the axial line 24A direction is set to be equal to or less than the length L1 of the developer carrying region 24B in the axial line 24A direction of the developer carrier 24, it is possible to suppress the air flow flowing through the third gap G3 from excessively spreading in the axial line 24A direction of the developer carrier 24.

Here, the difference (L1−L2) between the length L1 of the developer carrying region 24B in the axial line 24A direction of the developer carrier 24 and the length L2 of the third gap G3 in the axial line 24A direction of the developer carrier 24, and the toner scattering amount were measured. The measurement results are shown in FIG. 12.

Figure 12:
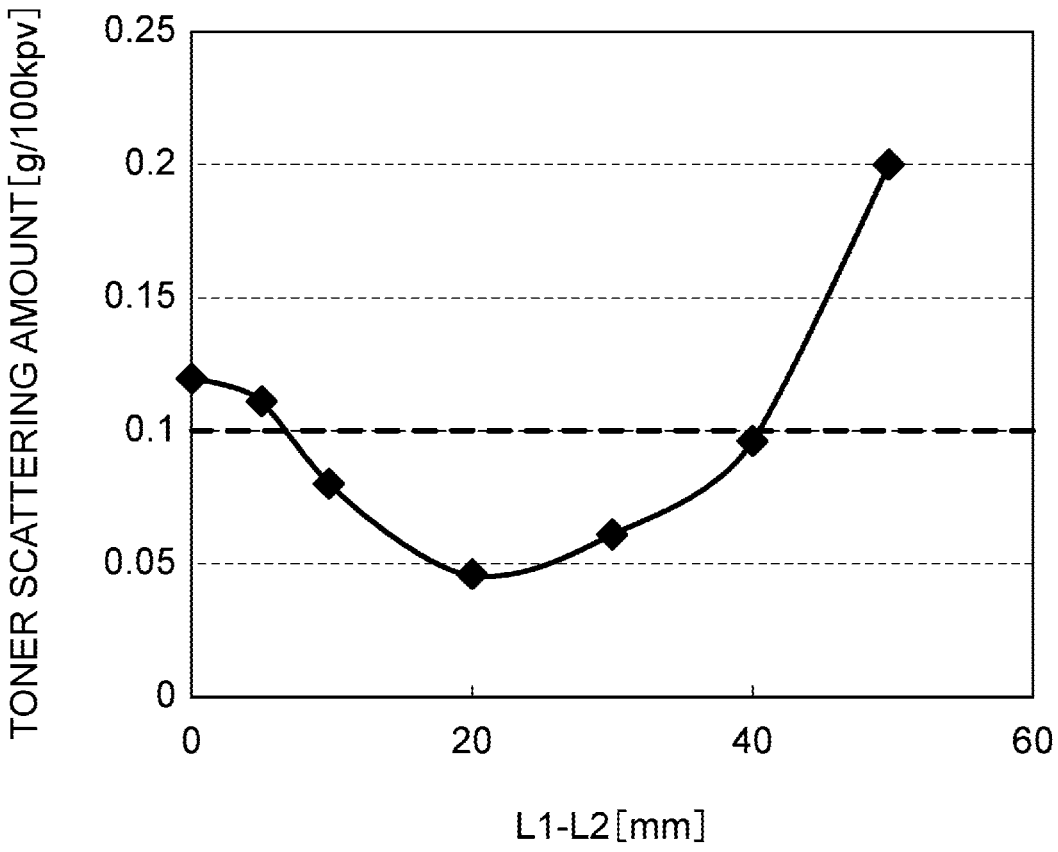
FIG. 12 is a graph showing measurement results.

As illustrated in FIG. 12, when the difference (L1−L2) was equal to or greater than 10 mm, the toner scattering amount was equal to or less than 0.01 g/min. It is conceived that this is because the air flow flowing through the third gap G3 does not easily spread in the axial line 24A direction of the developer carrier 24. In addition, if the difference (L1−L2) is equal to or less than 40 mm, the toner scattering amount becomes equal to or less than 0.01 g/min. It is conceived that this is because the air flow is appropriately formed in the third gap G3, so that a great amount of the air flow passing through the third gap G3 flows to the second gap G2 without interfering with the image carrier 40. This value of 0.01 g/min is an example of the target value of the toner scattering amount.

From the aforementioned result, by satisfying the relationship of 10 mm≤(L1−L2)≤40 mm, it is possible to prevent the air flow flowing through the third gap G3 from easily spreading in the axial line 24A direction of the developer carrier 24 and flow most of the air flow passing through the third gap G3 to the second gap G2 without interfering with the image carrier 40, in order to suppress toner scattering.

In addition, in a case where the third gap G3 is narrowed toward the image carrier 40 side in the axial line 24A direction of the developer carrier 24 using the end forming member 28 acting as a baffle plate, it is possible to prevent the air flow flowing through the third gap G3 from easily spreading in the axial line 24A direction of the developer carrier 24.

In addition, in a case where the relationship of S1<S2 is satisfied, it is possible to reduce the velocity of the air flow flowing through the third gap G3 by improving the velocity of the air flow flowing through the first gap G1. Consequently, it is possible to flow (or to channel) most of the air flow passing through the third gap G3 to the second gap G2 without interfering with the image carrier 40.

In addition, in a case where an end of the third gap G3 in the axial line 24A direction of the developer carrier 24 is blocked by the end forming member 28 as an elastic member, it is possible to more easily adjust the length of the third gap G3 in the axial line 24A direction of the developer carrier 24 by expanding or contracting the end forming member 28 as an elastic member.

In addition, in a case where the developer retainer 26 has a surface shape having a circular cross-sectional shape until the developer retainer 26 reaches the first gap G1 at least from the third gap G3 via the second gap G2, it is possible to guide the air flow flowing from the third gap G3 to the first gap G1 along the surface of the developer retainer 26, in order to efficiently circulate the air.

Figure 13:
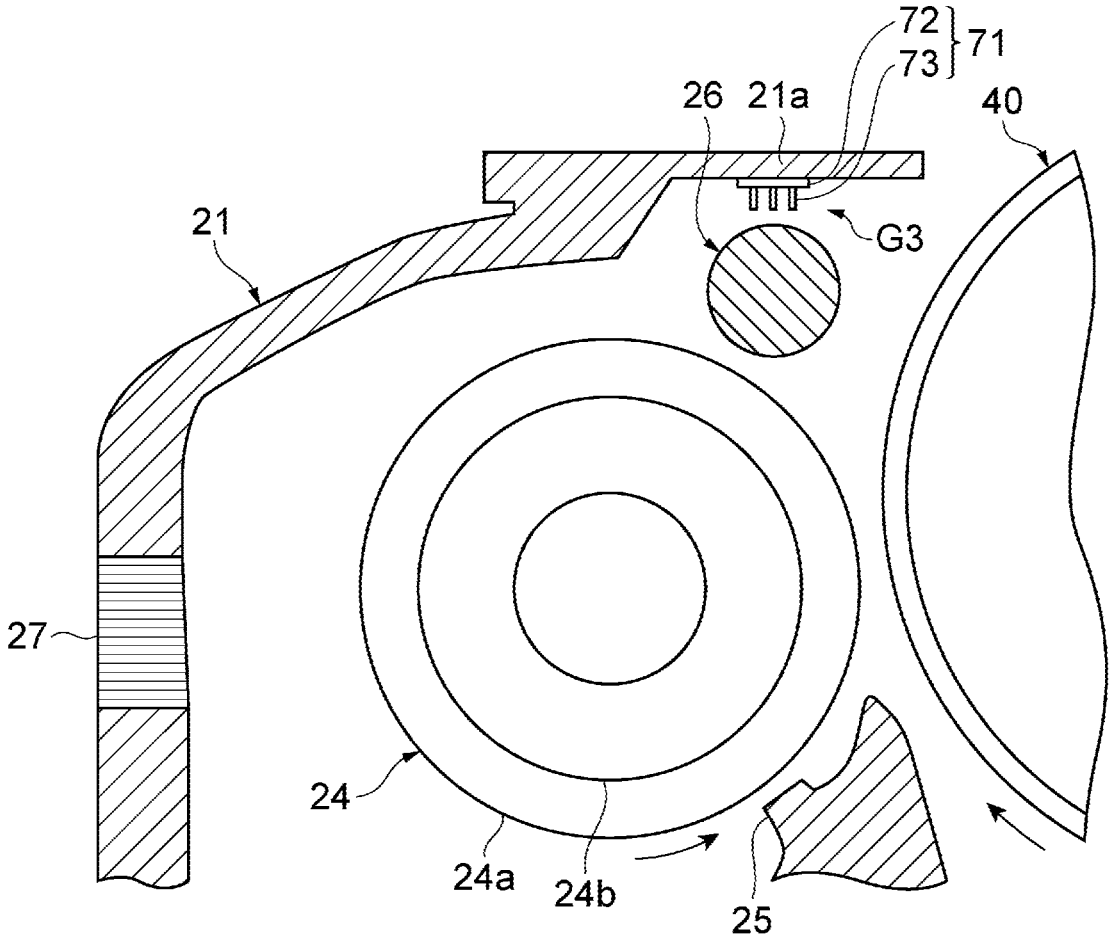
FIG. 13 is a schematic cross-sectional view of components of an example developing device.
Figure 14:
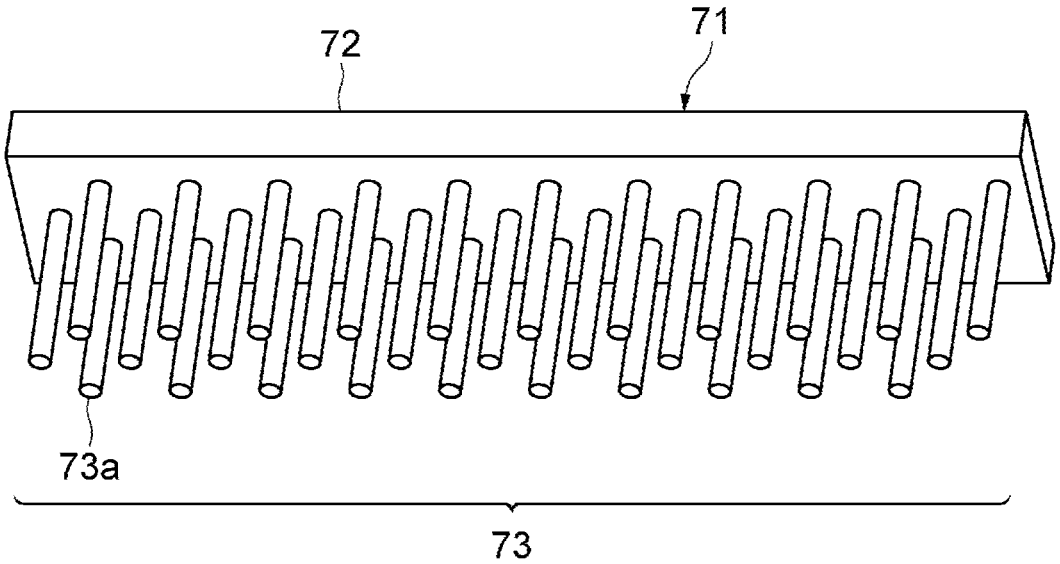
FIG. 14 is a schematic perspective view of a brush of an example developing device.
Figure 15:
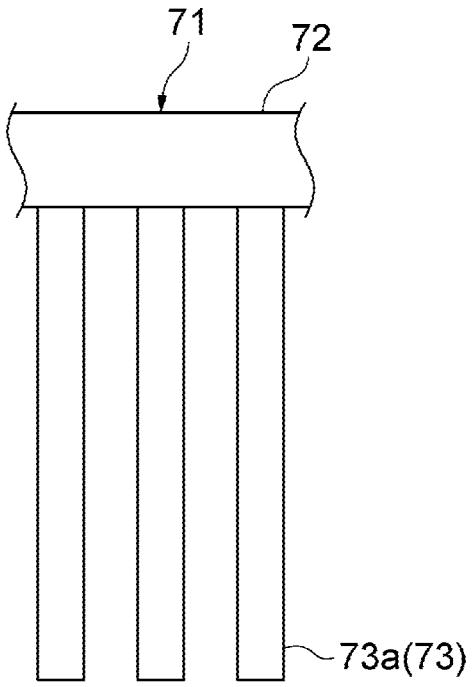
FIG. 15 is a schematic partial front view of an example brush.
Figure 16:
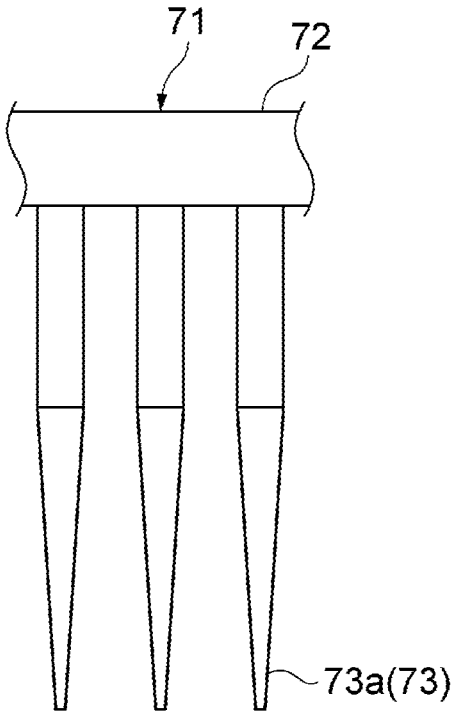
FIG. 16 is a schematic partial front view of an example brush.

As illustrated in FIG. 13, an example developing device 20 may have a brush 71. The brush 71 is provided in the casing top wall 21*a* of the container 21 in the third gap G3 and extends toward the developer retainer 26. As the air flow flowing from the inside of the container 21 to the outside of the container 21 via the third gap G3 collides with the brush 71, the toner falls down from the air flow, so that a toner concentration in this air flow decreases. Since the brush 71 serves as a resistance to this air flow, it is also called a resistance member. The brush 71 may be integrated into the container 21 or may be provided separately from the container 21.

The brush 71 has a base portion 72 installed in the casing top wall 21*a* and a brush portion 73 protruding from the base portion 72.

The base portion 72 is formed in a flat plate shape extending in the axial line 26A direction of the developer retainer 26 and is installed in the casing top wall 21*a* of the container 21. In a case where the brush 71 is provided across substantially the entire area in the direction of the axial line 26A direction of the developer retainer 26, a gap between the base portion 72 and the developer retainer 26 corresponds to the third gap G3.

The brush portion 73 extends from the base portion 72 toward the developer retainer 26. The brush portion 73 may extend from the container 21 downward in a vertical direction. The brush portion 73 may be formed of, for example, metal, resin, or the like. The brush portion 73 may be formed of, for example, a non-magnetic material. The non-magnetic material for forming the brush portion 73 may include, for example, SUS, or the like.

The brush portion 73 may include, for example, a plurality of rods 73*a* as illustrated in FIGS. 14 to 17. In the example brush 71 shown in FIGS. 14 and 15, each rod 73*a* of the brush portion 73 is formed in a columnar shape having the same cross section from the base portion 72 side to a tip side opposite to the base portion 72. In an example brush 71 shown in FIG. 16, each rod 73*a* of the brush portion 73 is formed in a tapered shape such that its cross section is narrowed from the base portion 72 end toward a tip opposite to the base portion 72 end. A cross-sectional shape of each rod 73*a* may include, for example, a circular shape, an elliptical shape, a polygonal shape, or the like.

Figure 17:
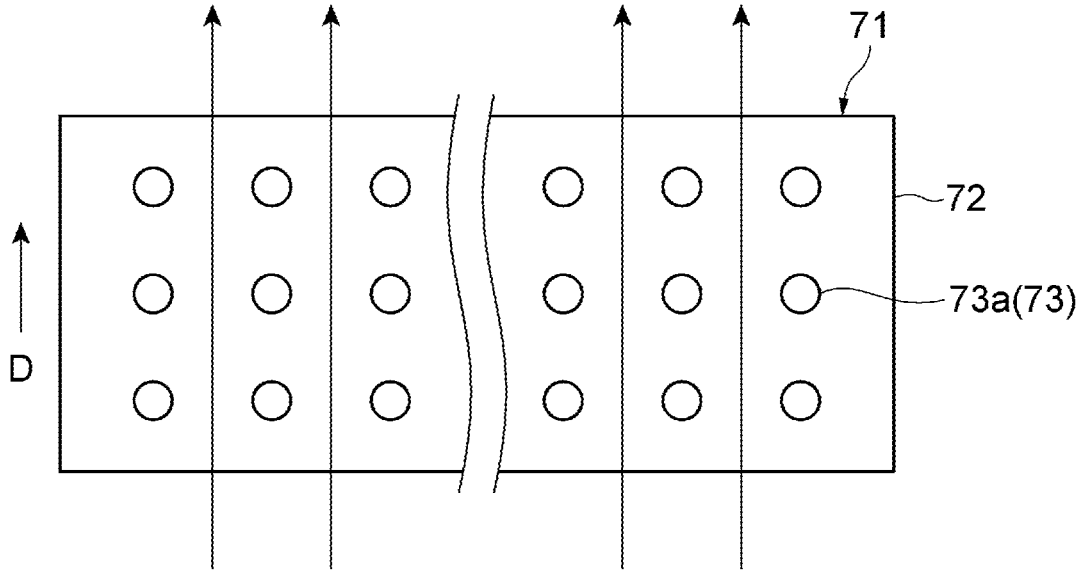
FIG. 17 is a schematic bottom view of an example brush.
Figure 18:
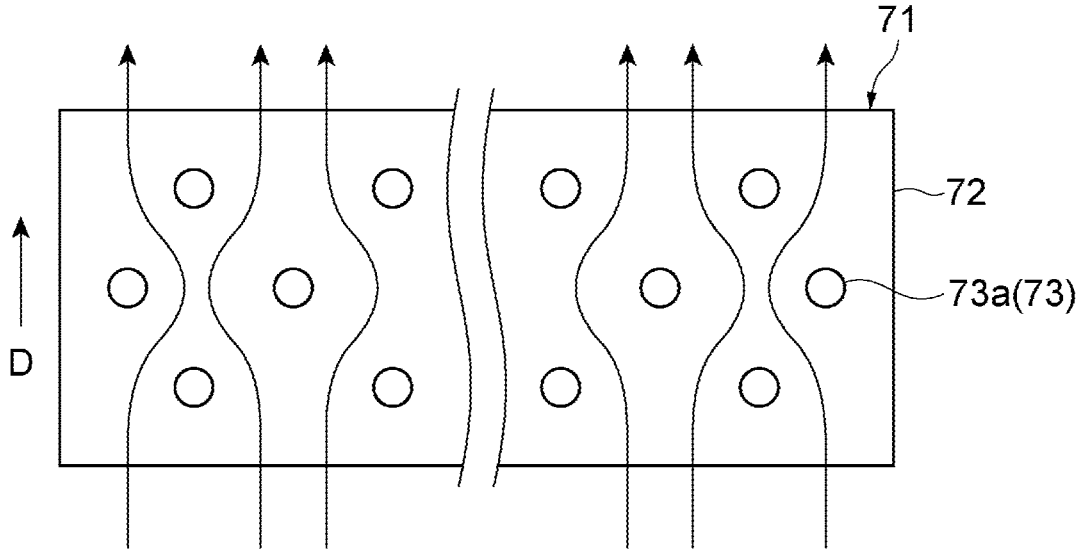
FIG. 18 is a schematic bottom view of an example brush.

In a case where the brush portion 73 includes a plurality of rods 73*a*, a plurality of rods 73*a* may be arranged across a plurality of stages in the air flow direction D passing through the third gap G3. In this case, the rods 73*a* may be arranged in a grid arrangement as illustrated in FIG. 17, in a staggered arrangement as illustrated in FIG. 18, and/or the like.

Figure 19:
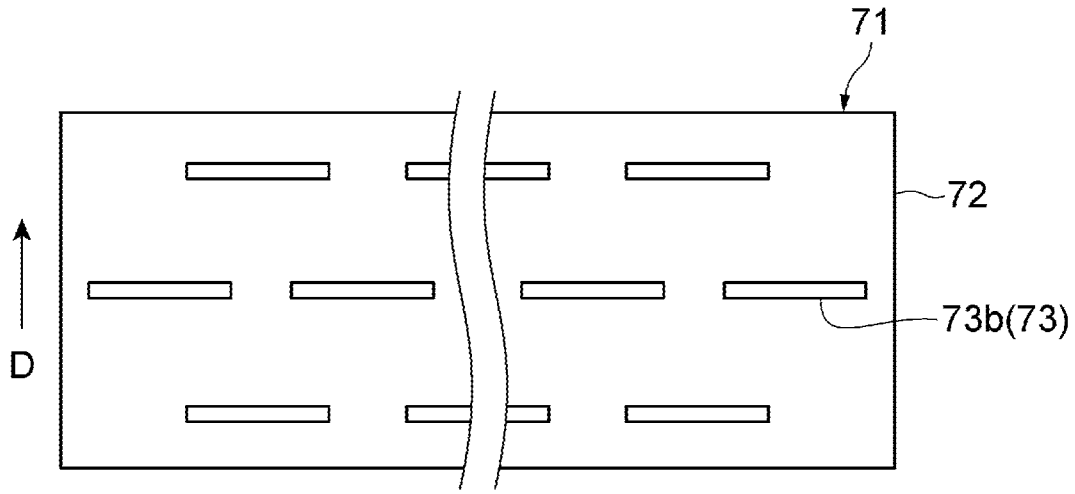
FIG. 19 is a schematic bottom view of an example brush.
Figure 20:
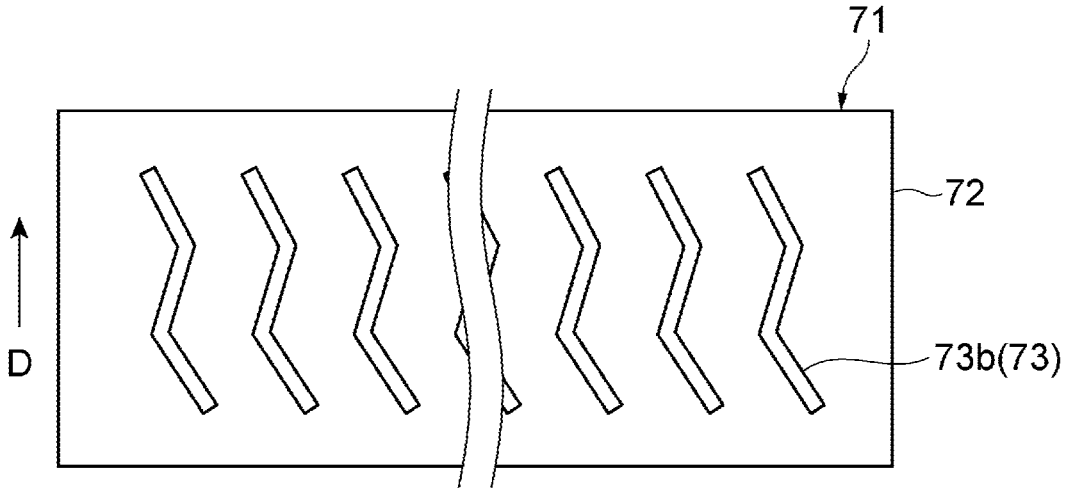
FIG. 20 is a schematic bottom view of an example brush.

In other examples, the brush portion 73 may include, for example, a plurality of fins 73*b* as illustrated in FIG. 19 or FIG. 20. A plurality of fins 73*b* are arranged, for example, in the air flow direction D passing through the third gap G3. In the brush 71 of FIG. 19, each fin 73*b* of the brush portion 73 is formed in a flat plate shape extending perpendicularly to the air flow direction D passing through the third gap G3. In the brush 71 of FIG. 20, each fin 73*b* of the brush portion 73 is formed in a bent plate shape sloped with respect to the air flow direction D passing through the third gap G3.

Figure 21:
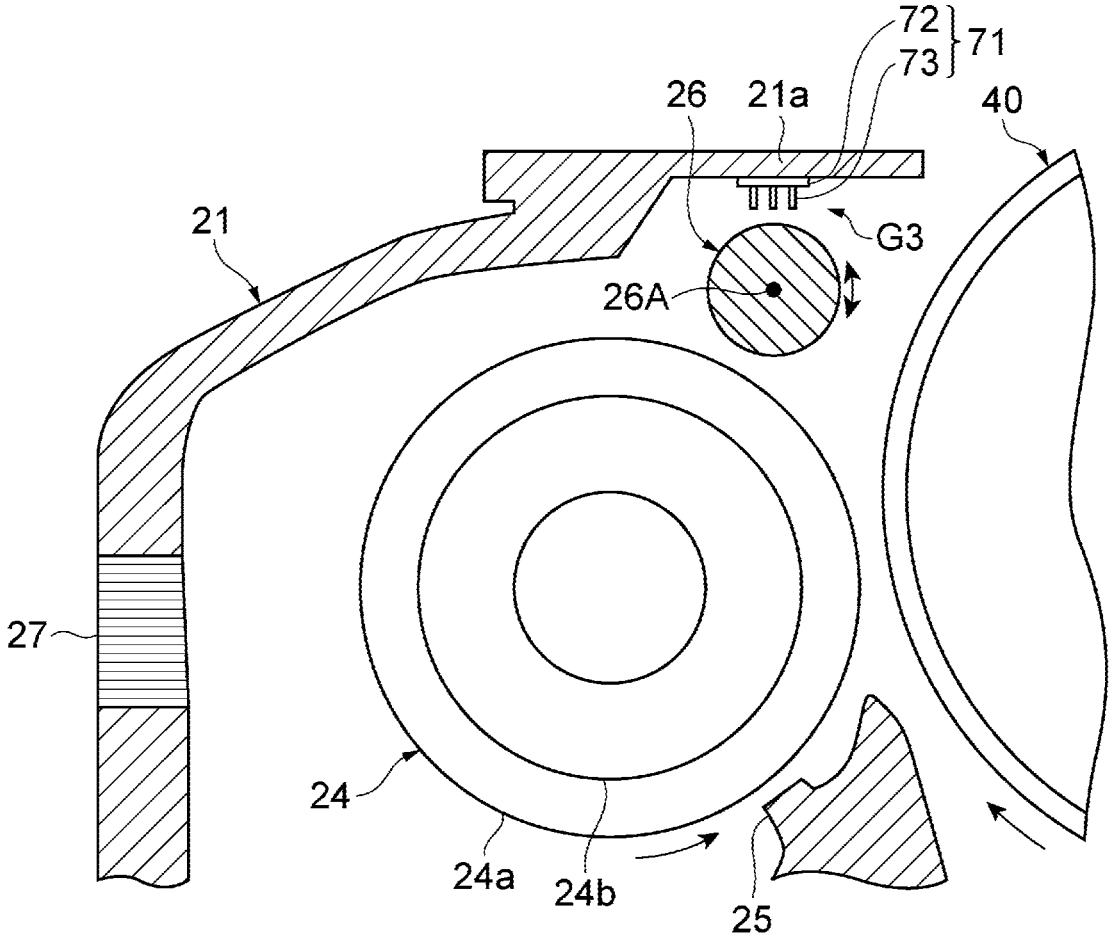
FIG. 21 is a schematic cross-sectional view of components of an example developing device.

In the example developing device 20 having the brush 71, a significant amount of the toner removed by the brush 71 falls down to the developer retainer 26. In this regard, in an example developing device 20 having the brush 71 illustrated in FIG. 21, in order to suppress deposition of the toner on the developer retainer 26, the developer retainer 26 may be rotatable with respect to the axial line 26A. In this case, for example, the developer retainer 26 is rotatably supported by the container 21, and is rotationally driven by a driving source (not illustrated) such as a motor.

Figure 22:
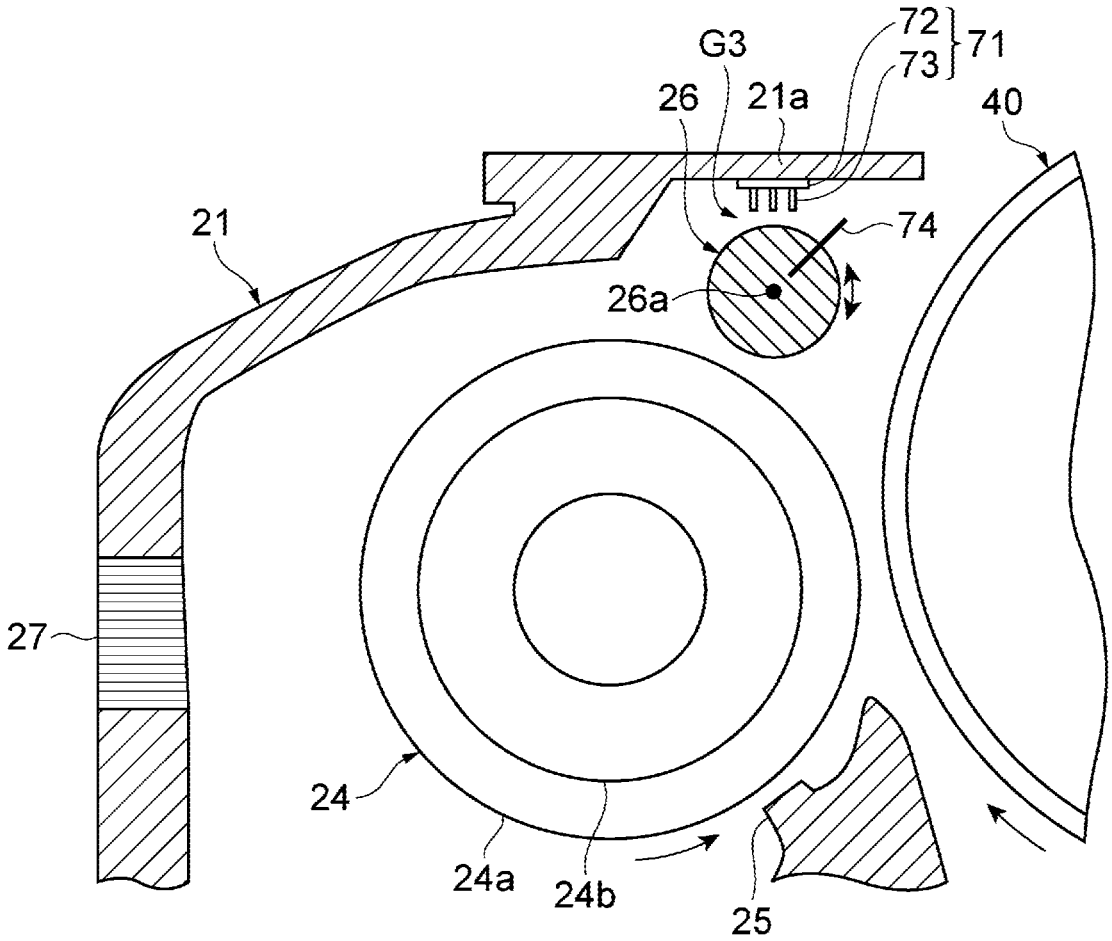
FIG. 22 is a schematic cross-sectional view of components of an example developing device.

In examples where the developer retainer 26 is rotatable, the developer retainer 26 may have a cleaning member 74 for cleaning the brush 71 as illustrated in FIG. 22. The cleaning member 74 rotates as the developer retainer 26 rotates. In addition, at least a part of the brush 71 is disposed on a rotation locus of the cleaning member 74. That is, as the developer retainer 26 rotates, the cleaning member 74 abuts on at least a part of the brush portion 73. Installation of the cleaning member 74 in the developer retainer 26 may be performed, for example, by providing a slit in the developer retainer 26 and fitting the cleaning member 74 into the slit.

Figure 23:
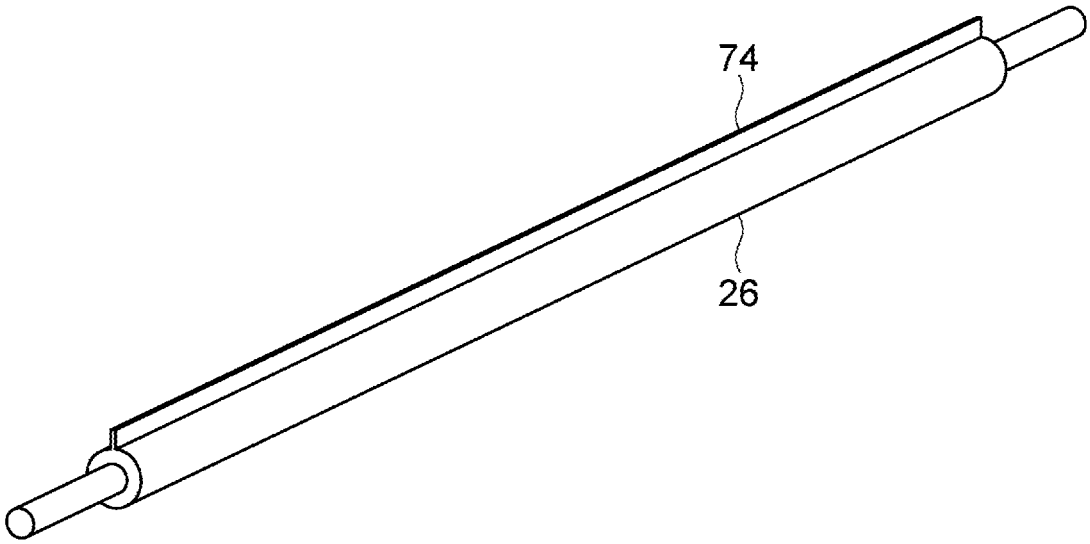
FIG. 23 is a schematic perspective view of an example developer retainer of an example developing device.
Figure 24:
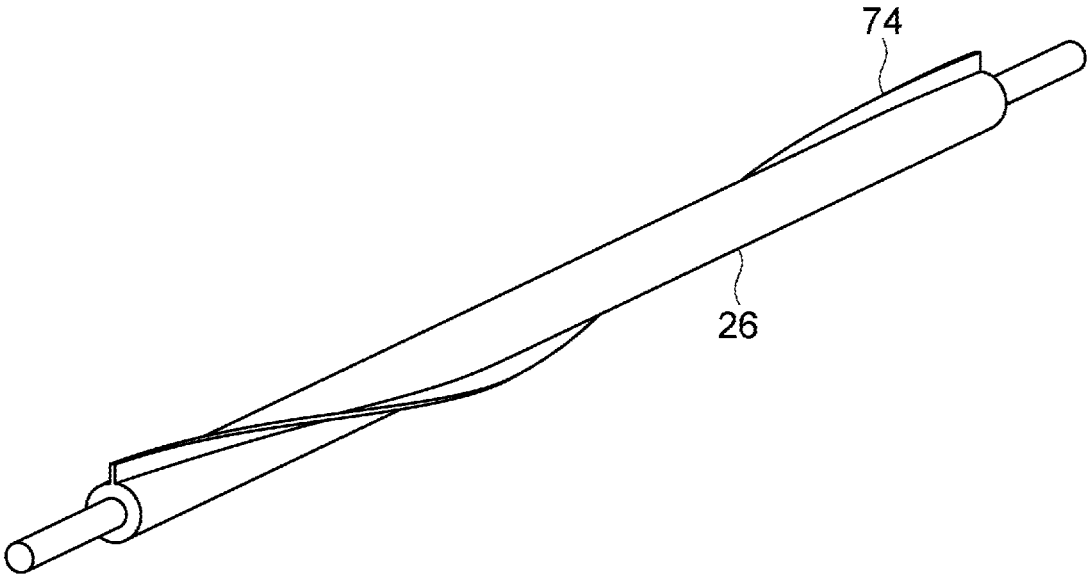
FIG. 24 is a schematic perspective view of an example developer retainer of an example developing device.

The cleaning member 74 may include, for example, a blade formed of an elastically deformable material such as rubber, a brush having a plurality of fibrous members transplanted to a base member, or the like. In a case where the blade is employed as the cleaning member 74, the cleaning member 74 may include, for example, a blade extending straight as illustrated in FIG. 23, or a blade extending in a spiral along the surface of the developer retainer 26 as illustrated in FIG. 24.

In example developing devices 20 having the brush 71, the air flow flowing from the inside of the container 21 to the outside of the container 21 through the third gap G3 collides with the brush 71. Then, the toner falls down from the air flow. Therefore, the toner concentration of this air flow decreases, in order to suppress toner scattering.

In examples where the brush 71 extends from the container 21 downward in a vertical direction, the toner colliding with the brush 71 may fall down by gravity. Therefore, it is possible to suppress the toner from being attached to the brush 71.

In addition, in a case where the brush 71 is formed of a non-magnetic material, it is possible to suppress the carrier from being attached to the brush 71, in order to suppress a variation of the third gap G3.

In examples where the brush portion 73 includes a plurality of rods 73*a*, the air flow passing through the third gap G3 is more easily disturbed. Therefore, the toner can more easily fall down from the air flow passing through the third gap G3. In an example where a plurality of rods 73*a* are arranged in a staggered manner, the air flow passing through the third gap G3 becomes convoluted. Therefore, the toner can more easily fall down from the air flow passing through the third gap G3.

In an example where the brush portion 73 includes a plurality of rods 73*a*, the density of the plurality of rods 73*a*, the toner scattering amount, and the ADR scattering amount were measured. The ADR scattering amount is the amount described below. The developing device 20 discharges the used developer from the developer outlet provided in the container 21. However, as an internal pressure of the container 21 increases, the internal air of the container 21 is blown out from the developer outlet. Therefore, the developer is discharged excessively from the developer outlet along with this air flow. The amount of the developer excessively discharged from the developer outlet along with this air flow is referred to as the "ADR scattering amount". The ADR scattering amount does not include the amount of the developer discharged without increasing the internal pressure of the container 21. The density of the plurality of rods 73*a* was obtained by a total cross section area of the plurality of rods 73*a* against an area of a rectangle circumscribed about the plurality of rods 73*a*. The toner scattering amount was measured as described above. The ADR scattering amount was measured as follows. First, an amount of the developer less than a usual amount of the developer for starting a discharge of the developer by 30 to 50 g was contained (or stored) in the container 21. This amount of the developer is set to form the developer napping using the developer carrier 24 while disabling a normal discharge of the developer. Furthermore, a pouch for storing the developer was provided in the developer outlet. Moreover, the developing device 20 was operated for a predetermined period of time, for example, approximately sixty minutes, and the amount of the developer contained in this pouch was measured. Then, a value obtained by dividing this measurement amount by the operation time of the developing device 20 was set as the ADR scattering amount. The measurement results are shown in FIG. 25.

Figure 25:
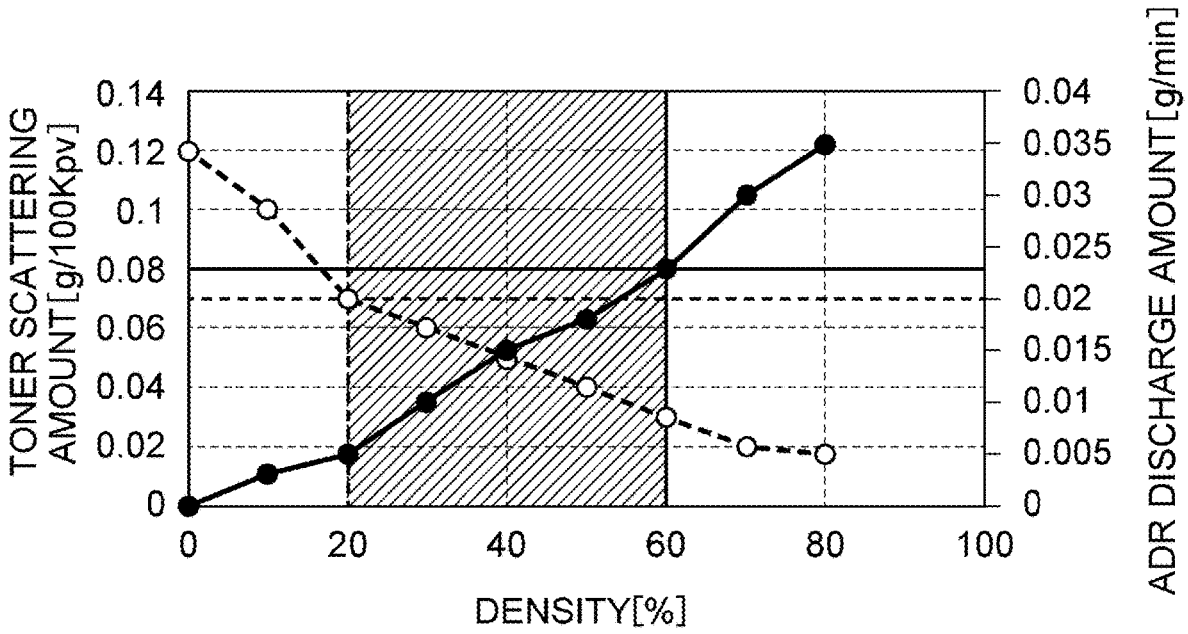
FIG. 25 is a graph showing measurement results.

As shown in FIG. 25, when the density of the plurality of rods 73*a* is equal to or higher than 20%, the toner scattering amount was equal to or less than 0.07 g/100K pv. It is conceived that this is because the toner scattering amount is suppressed as the toner collides with a plurality of rods 73*a*. This value 0.07 g/100K pv is an example of the target value of the toner scattering amount. In addition, when the density of the plurality of rods 73*a* was equal to or lower than 60%, the ADR scattering amount was equal to or less than 0.023 g/min. It is conceived that this is because the ADR scattering amount is reduced by appropriately maintaining the internal pressure of the container 21. This value 0.023 g/min is an example of the target value of the ADR scattering amount.

From the aforementioned result, if the density of the plurality of rods 73*a* is equal to or higher than 20% and equal to or lower than 60%, it is possible to suppress the ADR scattering amount while suppressing the toner scattering amount.

In addition, in a case where the brush portion 73 includes a plurality of rods 73*a*, the density of the plurality of rods 73*a* may increase as the area of the air flow flowing through the third gap G3 increases. In addition, the density of the plurality of rods 73*a* may decrease as the area of the air flow flowing through the third gap G3 decreases.

Figure 27:
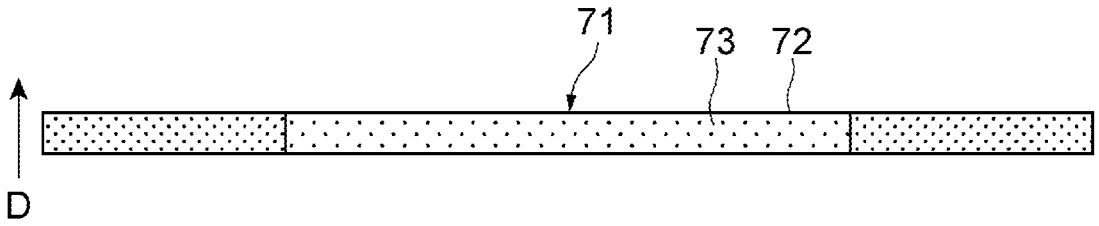
FIG. 27 is a schematic bottom view of an example brush of an example developing device.

Since the air flow passing through the third gap G3 flows more easily to both sides in the axial line 26A direction of the developer retainer 26, the amount of the air flow flowing through the third gap G3 may more easily increase in a center region of the axial line 26A direction of the developer retainer 26. In addition, the amount of the air flow flowing through the third gap G3 may more easily decrease in side regions of the axial line 26A direction of the developer retainer 26. Accordingly, as illustrated in FIG. 27, the density of the plurality of rods 73*a* may be set to be lower in the center region of the third gap G3 in the axial line 26A direction of the developer retainer 26, compared to the side regions of the third gap G3. The density of the plurality of rods 73*a* may be set to be higher in the side regions of the third gap G3, compared to the center region of the third gap G3. Consequently, it is possible to efficiently remove the toner from the air flow flowing through the third gap G3.

Figure 28:
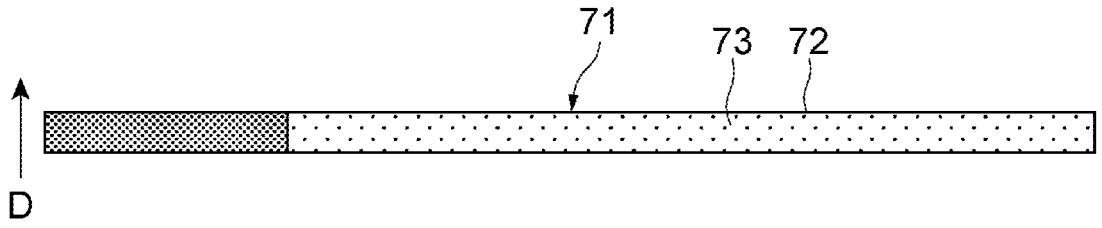
FIG. 28 is a schematic bottom view of an example brush of an example developing device.

In some examples, the density of the plurality of rods 73*a* may be set to be higher in a region to suppress a discharge of the toner from the container 21 in that region. For example, a driving mechanism for rotationally driving the image carrier 40 or the like, may be provided, at a left end (or left region) of the brush, based on a view where the brush 71 side is seen from the developer retainer 26 side (e.g. where the brush 71 is seen from a side of the brush 71 facing or adjacent the developer retainer 26). In this case, as illustrated in FIG. 28, the density of the plurality of rods 73*a* may be set to be higher at the left region of the third gap G3, when the brush 71 is viewed from the developer retainer 26 side, compared to the density of other regions, in order to direct the toner discharged from the container 21 toward a side where the density of the plurality of rods 73*a* is lower. Therefore, it is possible to reduce the toner amount, for example, flowing toward the driving mechanism for rotationally driving the image carrier 40 or the like.

In examples where the developer retainer 26 is rotatable, the toner falling down from the brush 71 is deposited on the developer retainer 26. Even in this case, the toner can be removed from the developer retainer 26 by rotating the developer retainer 26. Consequently, it is possible to suppress deposition of the toner from narrowing the third gap G3.

In examples where the developer retainer 26 has the cleaning member 74, it is possible to remove the toner attached to the brush 71, from the brush 71. Consequently, it is possible to maintain the flow rate of the air flow in the third gap G3 for a longer time.

In examples where the cleaning member 74 extends in a spiral shape, it is possible to position the cleaning member 74 to partially abut on the brush 71 and change the abutting position of the cleaning member 74 against the brush 71 depending on the rotation position of the developer retainer 26. Consequently, it is possible to reduce the rotation torque of the developer retainer 26 and improve durability of the brush 71 and the cleaning member 74.

A relationship between the number of printed sheets and the third gap G3 was measured for a case where the brush 71 is provided, but the cleaning member 74 is not provided (Example A) and a case where both the brush 71 and the cleaning member 74 are provided (Example B). The measurement results are shown in FIG. 26.

Figure 26:
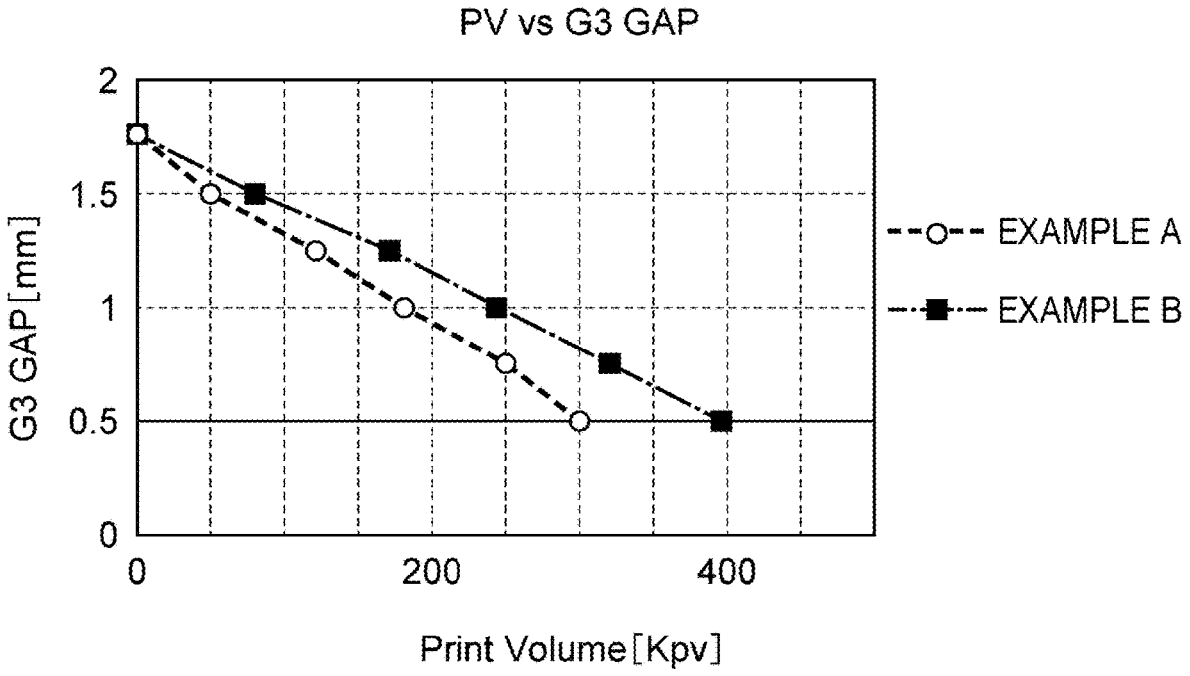
FIG. 26 is a graph showing measurement results.

Based on the results shown in FIG. 26, the third gap G3 is narrowed due to deposition of the toner as the printing is repeated. However, a narrowing rate of the third gap G3 is less in Example B, compared to Example A.

From the aforementioned results, it is possible to reduce the narrowing rate of the third gap G3 over time by providing the brush 71 and additionally the cleaning member 74.

Figure 29:
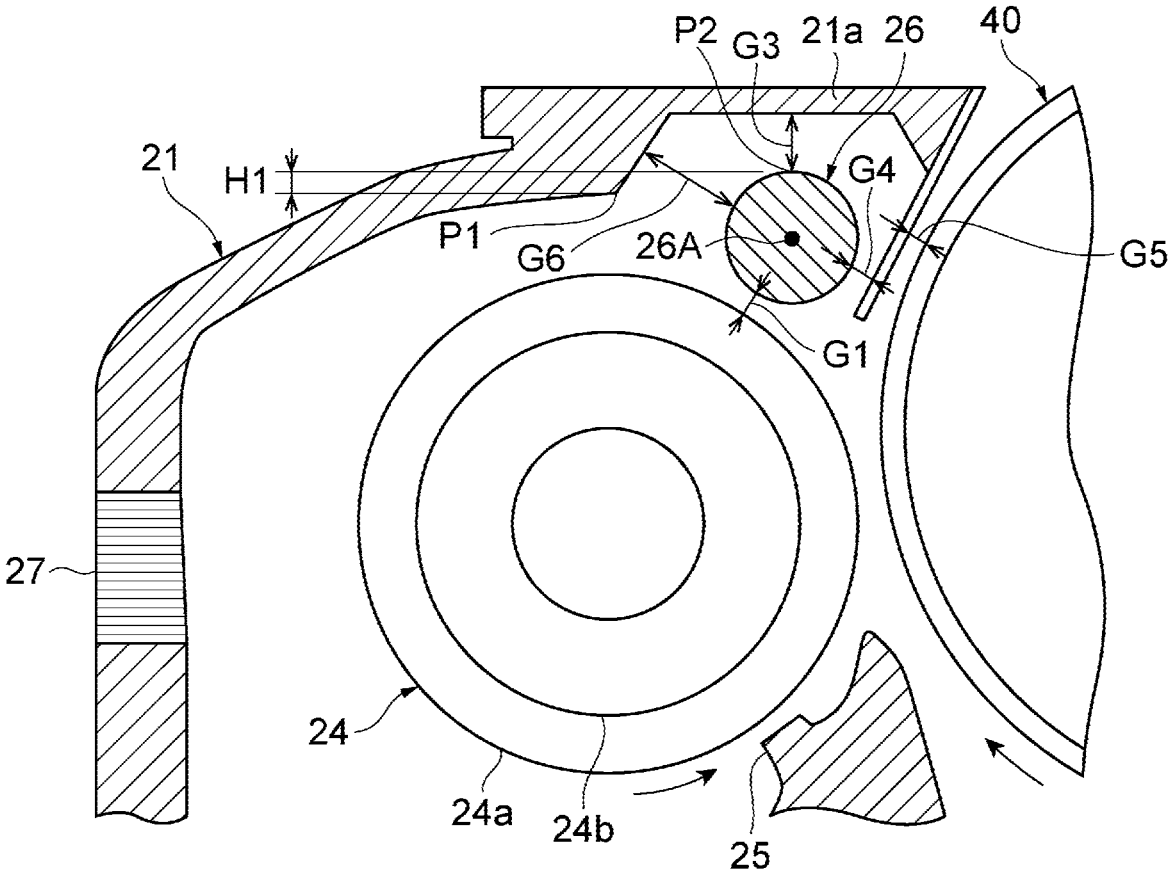
FIG. 29 is a schematic cross-sectional view of components of an example developing device.
Figure 30:
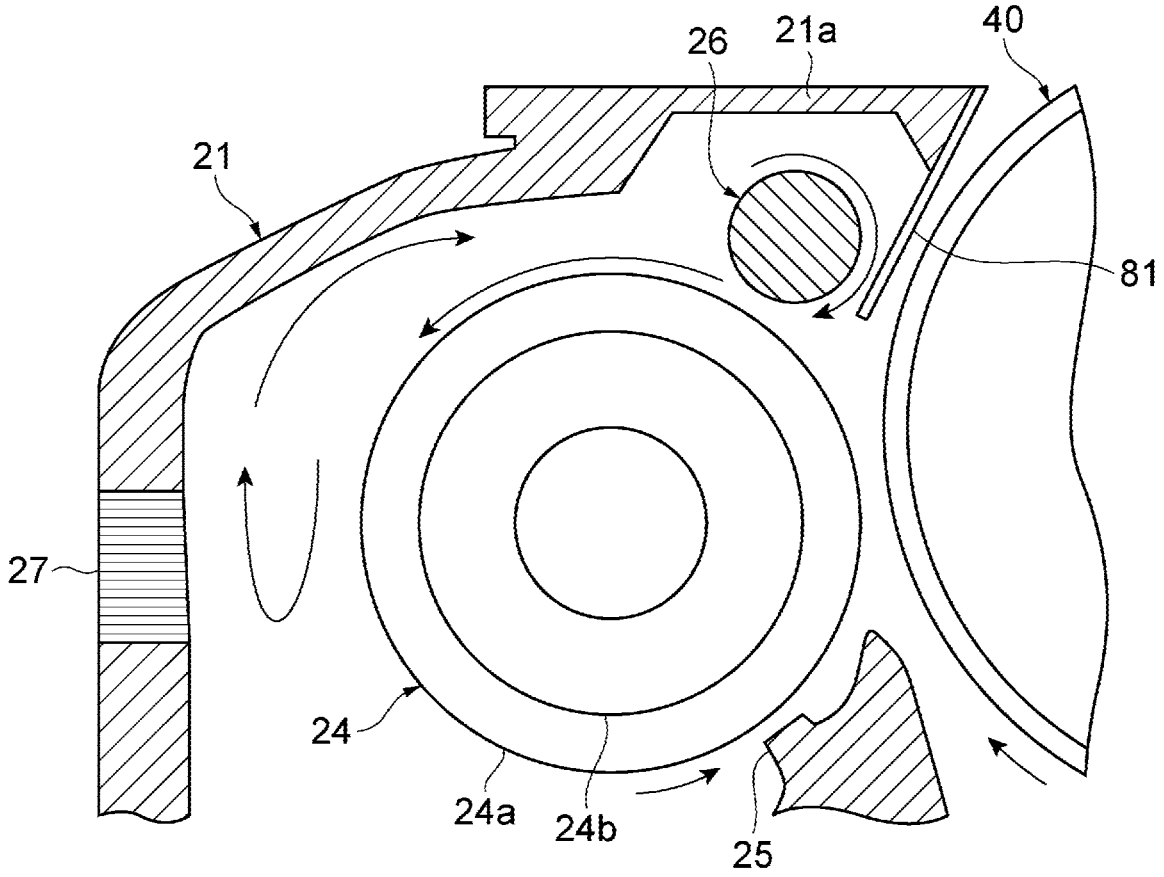
FIG. 30 is a schematic cross-sectional view of components of an example developing device.

As illustrated in FIGS. 29 and 30, an example developing device 20 may have a guide member 81 provided in the container 21 and extending toward the second gap G2.

The guide member 81 guides the air flow passing through the third gap G3 toward the first gap G1. The guide member 81 may be separated from the developer retainer 26 by a closest fourth gap G4 (or fourth gap G4). The guide member 81 may be separated from the image carrier 40 by a closest fifth gap G5 (or fifth gap G5). The fourth gap G4 refers to a gap (or space) between the developer retainer 26 and the guide member 81 and may also represents a distance of this gap, that is, the closest distance between the developer retainer 26 and the guide member 81. The fifth gap G5 refers to a gap (or space) between the image carrier 40 and the guide member 81 and may also represent a distance of this gap, that is, the closest distance between the image carrier 40 and the guide member 81.

The guide member 81 may be formed from, for example, a film-like member. The guide member 81 may be formed integrally with the container 21 or separately from the container 21. In an example where the guide member 81 is formed separately from the container 21, the guide member 81 may be detachably installed in the container 21. Detachable installation of the guide member 81 in the container 21 may be performed, for example, by fitting, screw fastening, and/or the like.

The guide member 81 extends from the container 21 to a tip (or tip end) that may be positioned at various locations between the container 21 and the developer carrier 24. For example, the tip of the guide member 81 may be positioned toward the container 21 rather than at the second gap G2 in some examples, or in other examples, the tip may be positioned in the second gap G2, or in yet other examples, the tip may be located closer toward the developer carrier 24 rather than at the second gap G2.

The guide member 81 may include an elastically deformable elastic material. Such an elastic material may include, for example, a PET film having a thickness of approximately 0.05 to 0.5 mm or a urethane rubber sheet having a thickness of approximately 0.1 to 0.5 mm. In some examples where at least a part of the guide member 81 is formed of an elastically deformable elastic material, the guide member 81 may be disposed to abut on the developer retainer 26 and to be separated from the developer retainer 26 as it is elastically deformed by the air flow flowing from the container 21 toward the third gap G3 as illustrated in FIGS. 31 to 34. Such a guide member 81 may be formed from, for example, a resin sheet or a resin film. Such a resin sheet or resin film may include, for example, a PET film having a thickness of approximately 0.03 to 0.2 mm or a urethane rubber sheet having a thickness of approximately 0.1 to 0.3 mm.

Figure 31:
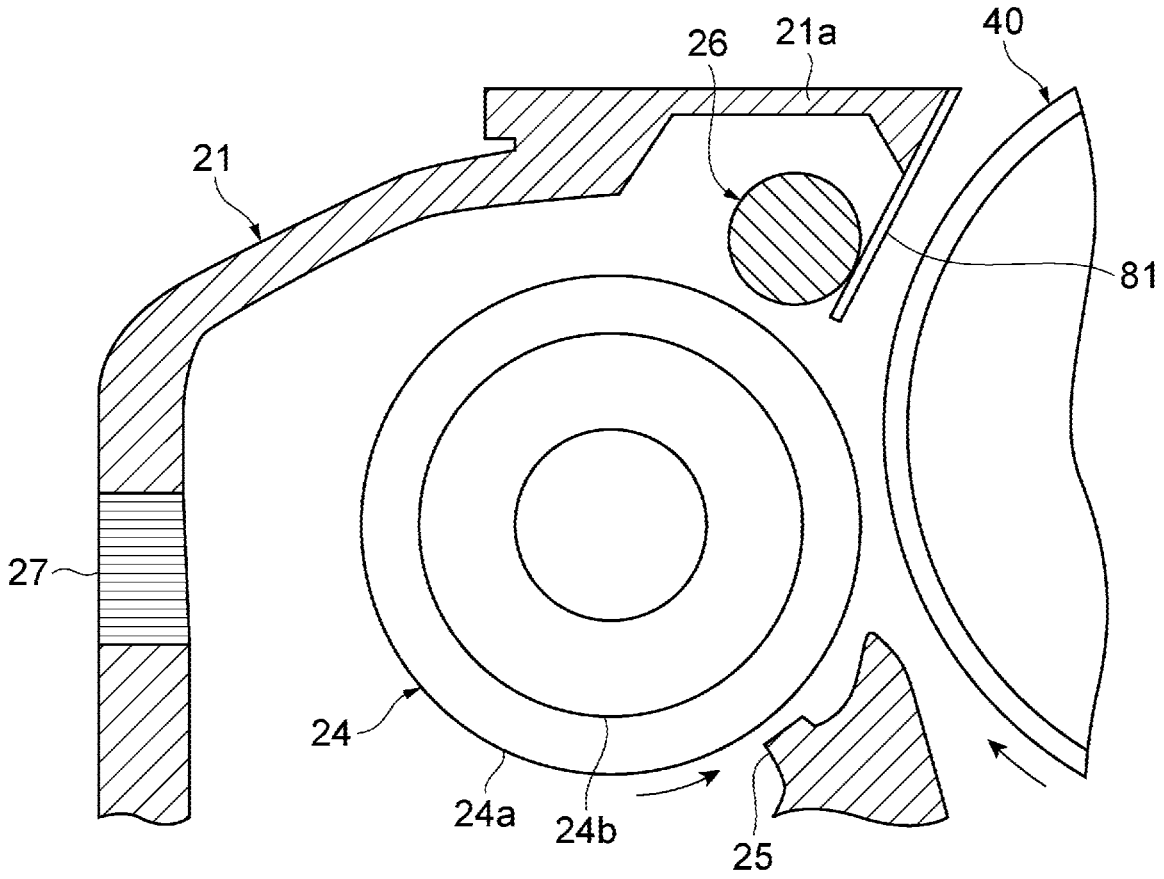
FIG. 31 is a schematic cross-sectional view of components of an example developing device.
Figure 32:
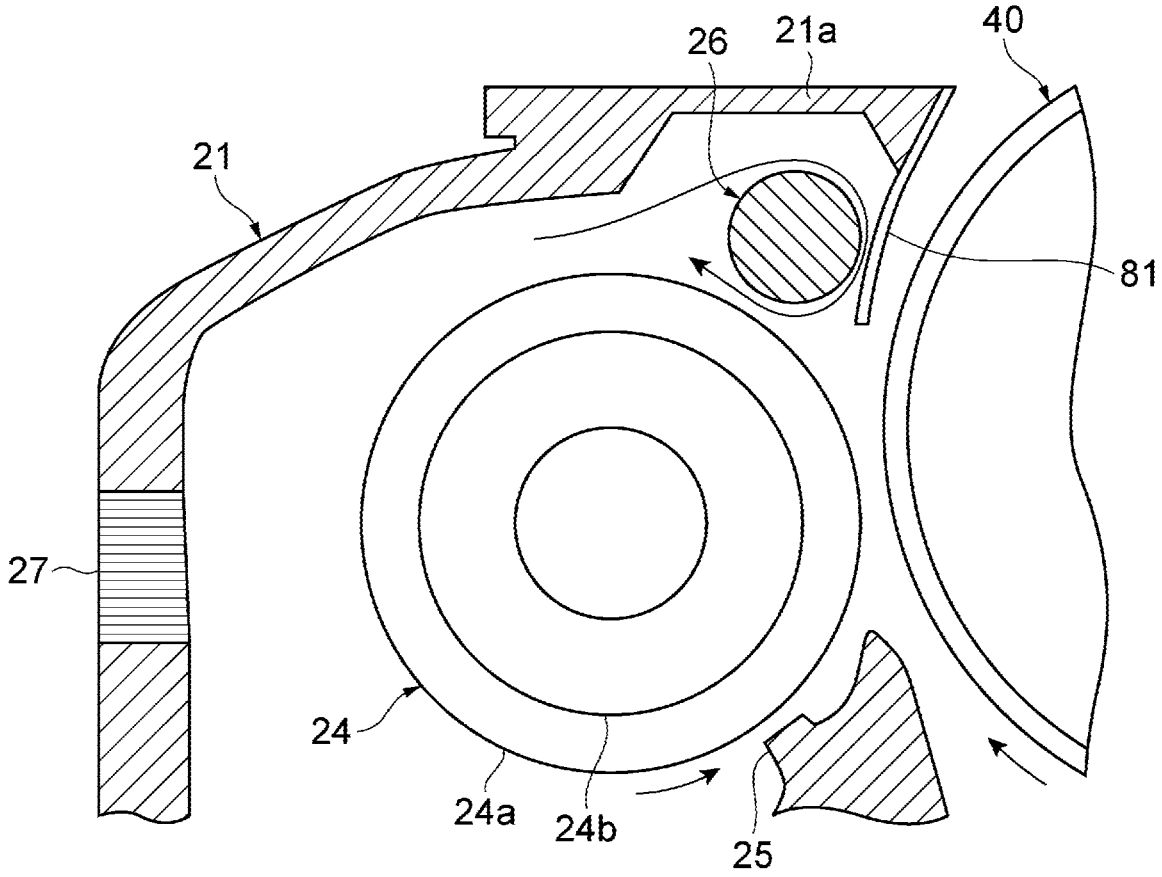
FIG. 32 is a schematic cross-sectional view of components of an example developing device.

The guide member 81 of the example shown in FIGS. 31 and 32 is formed in a flat plate shape. As illustrated in FIG. 31, the guide member 81 abuts on the developer retainer 26 in the second gap G2 or in the vicinity of the second gap G2 in a position facing the image carrier 40 of the developer retainer 26. Accordingly, the guide member 81 closes the flow passage of the air flow passing through the second gap G2. The tip of the guide member 81 is positioned toward the developer carrier 24 beyond the second gap G2, rather than at the second gap G2. In addition, in FIG. 32, the guide member 81 is elastically deformed by the air flow flowing from the container 21 toward the third gap G3 so as to be separated from the developer retainer 26. Consequently, the flow passage of the air flow passing through the second gap G2 is opened, so that the air flow flows from the fourth gap G4 to the first gap G1.

Figure 33:
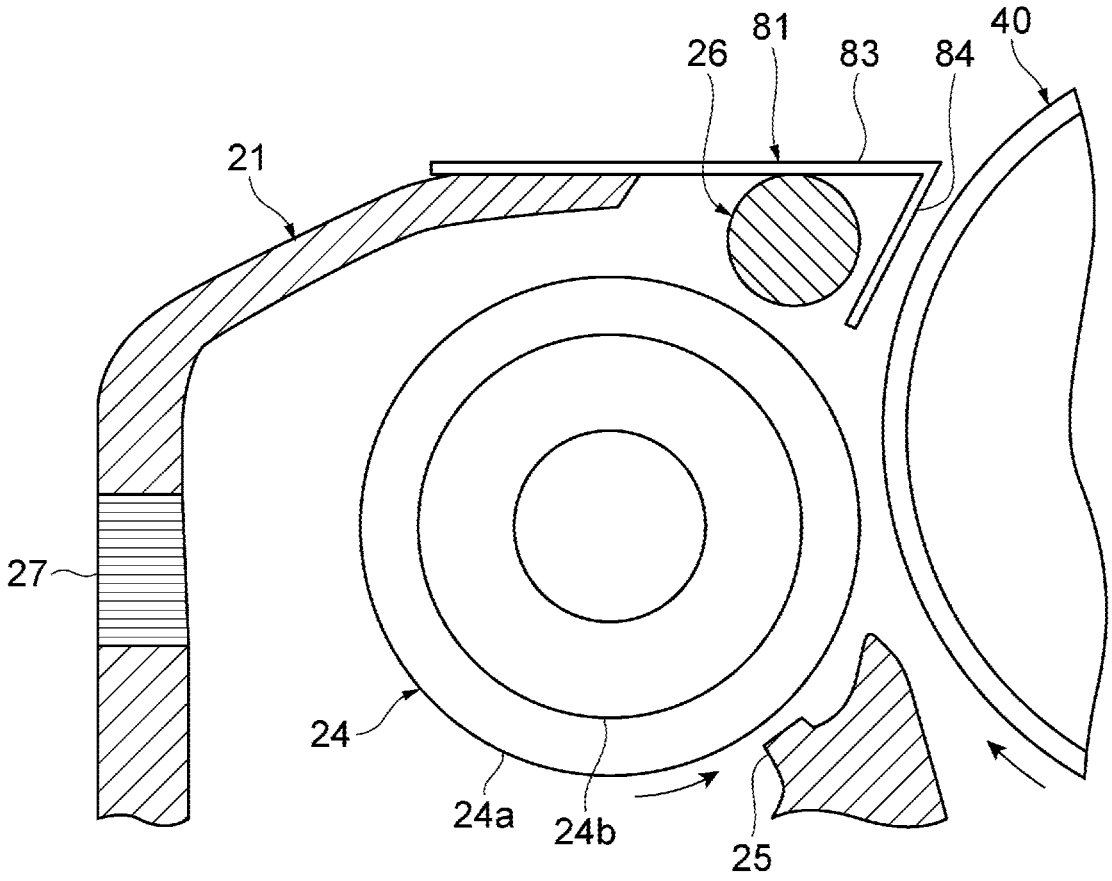
FIG. 33 is a schematic cross-sectional view of components of an example developing device.
Figure 34:
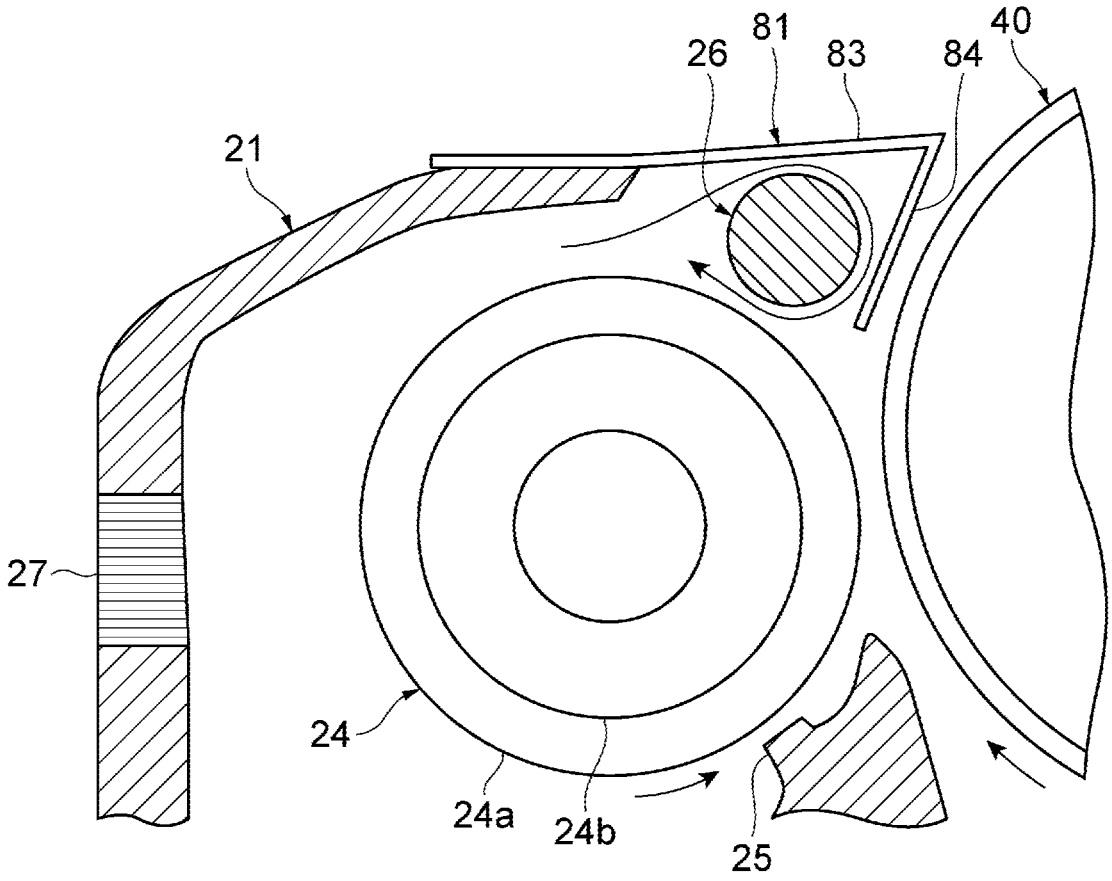
FIG. 34 is a schematic cross-sectional view of components of an example developing device.

The guide member 81 of FIGS. 33 and 34 is formed in a bent plate shape. This guide member 81 includes a first guide portion 83 installed in the container 21 and a second guide portion 84 bent from the first guide portion 83 to extend toward the second gap G2. The example developing device 20 shown in FIGS. 33 and 34 does not have any casing top wall 21*a* of the container 21. The container 21 does not extend over the developer retainer 26, but instead the transfer belt 31 (shown in FIG. 1) is disposed. That is, the developer retainer 26 faces the transfer belt 31.

As illustrated in FIG. 33, the first guide portion 83 of the guide member 81 abuts on the developer retainer 26 at a position of the the developer retainer 26 that faces the transfer belt 31. Accordingly, the guide member 81 closes the flow passage of the air flow passing through the third gap G3. A tip of the second guide portion 84 is positioned toward the developer carrier 24 beyond the second gap G2, rather than at the second gap G2. In addition, as illustrated in FIG. 34, the guide member 81 is elastically deformed by the air flow flowing from the container 21 toward the third gap G3 so as to be separated from the developer retainer 26. Consequently, the flow passage of the air flow passing through the third gap G3 is opened, so that the air flow flows from the fourth gap G4 to the first gap G1.

Accordingly, in examples where the guide member 81 is provided, the air flow passing through the third gap G3 is guided toward the first gap G1 by the guide member 81. Consequently, it is possible to suppress toner scattering caused by a discharge of the air flow to the outside of the container 21.

In examples where the guide member 81 is detachably installed in the container 21, it is possible to improve ease of assembly and maintenance of the example developing device 20. In addition, it is possible to better achieve miniaturization.

In examples where the guide member 81 is configured deform elastically so as to abut on the developer retainer 26, a discharge flow passage from the container 21 may be closed when the container 21 has a low internal pressure, or otherwise opened when the container 21 has a high internal pressure. Accordingly, it is possible to suppress toner scattering when the internal pressure of the container 21 is low.

In examples where the transfer belt 31 is disposed over the developer retainer 26 and the container 21 extends short of the developer retainer 26 (without covering the developer retainer 26), it is possible to reduce the height dimension.

Figure 35:
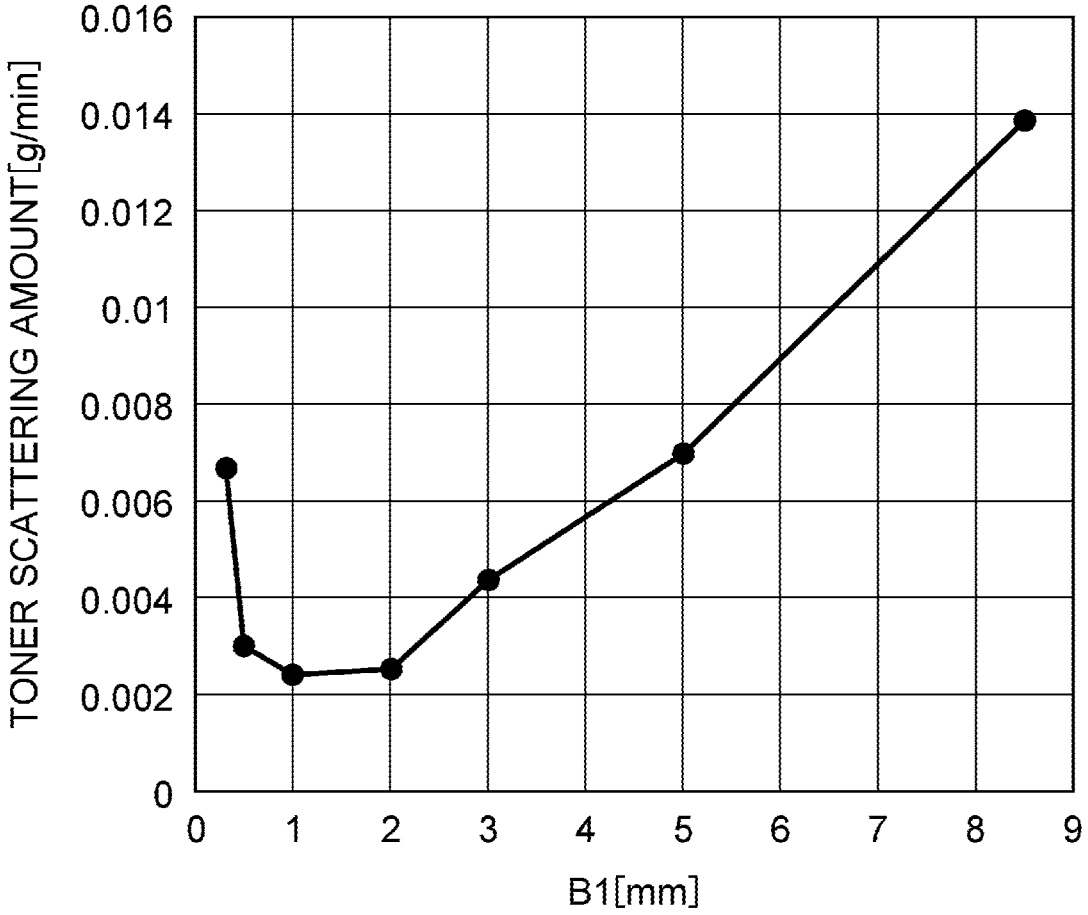
FIG. 35 is a graph showing measurement results.

The distance D1 between the developer carrier 24 and the guide member 81, and the toner scattering amount were measured. The toner scattering amount was measured as described above. The measurement results are shown in FIG. 35. Based on the results shown in FIG. 35, in a case where the distance D1 is longer than 0.5 mm and equal to or shorter than 2 mm (e.g. where the distance D1 is between 0.5 mm exclusive and 2 mm inclusive), the toner scattering amount was remarkably reduced. It is conceived that this is because the air flow can flow from the fourth gap G4 to the first gap G1 by suppressing an effect of the external air. Based on these results, the distance D1 may also be longer than 0.5 mm and equal to or shorter than 2 mm, or between 0.5 mm and 2 mm.

Figure 36:
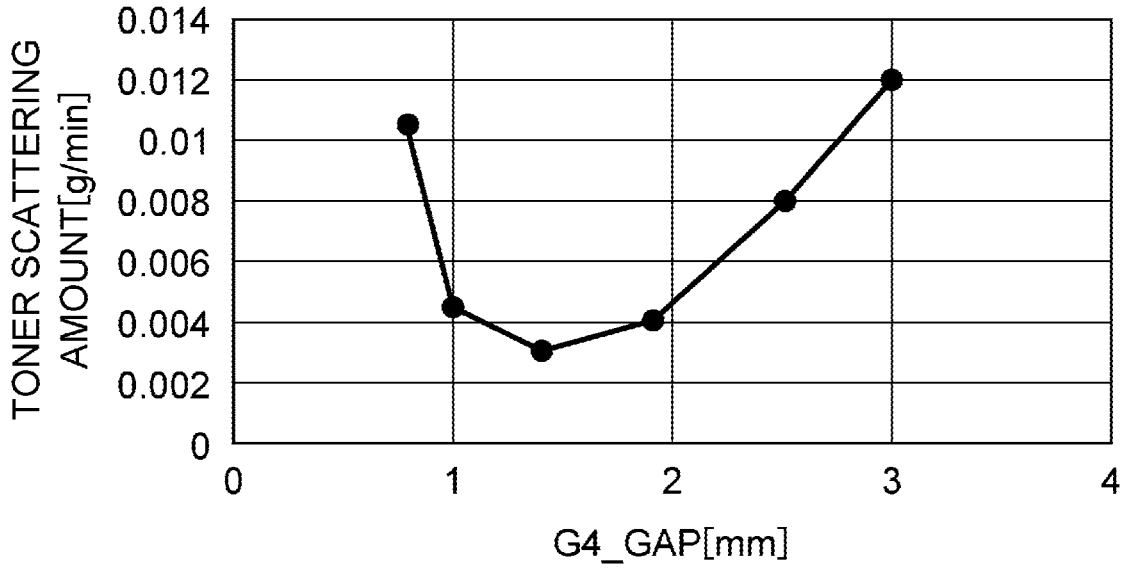
FIG. 36 is a graph showing measurement results.

The fourth gap G4 and the toner scattering amount were measured. The toner scattering amount was measured as described above. The measurement results are shown in FIG. 36. Based on the results shown in FIG. 36, where the fourth gap G4 is equal to or greater than 1 mm and equal to or less than 2 mm (e.g. between 1 mm and 2 mm, inclusive), the toner scattering amount is reduced. It is conceived that this is because this arrangement suitably forms the air flow flowing from the fourth gap G4 to the first gap G1. Accordingly, the fourth gap G4 may be between 1 mm and 2 mm, inclusive (e.g. the fourth gap G4 may be equal to or greater than 1 mm and equal to or less than 2 mm).

Figure 37:
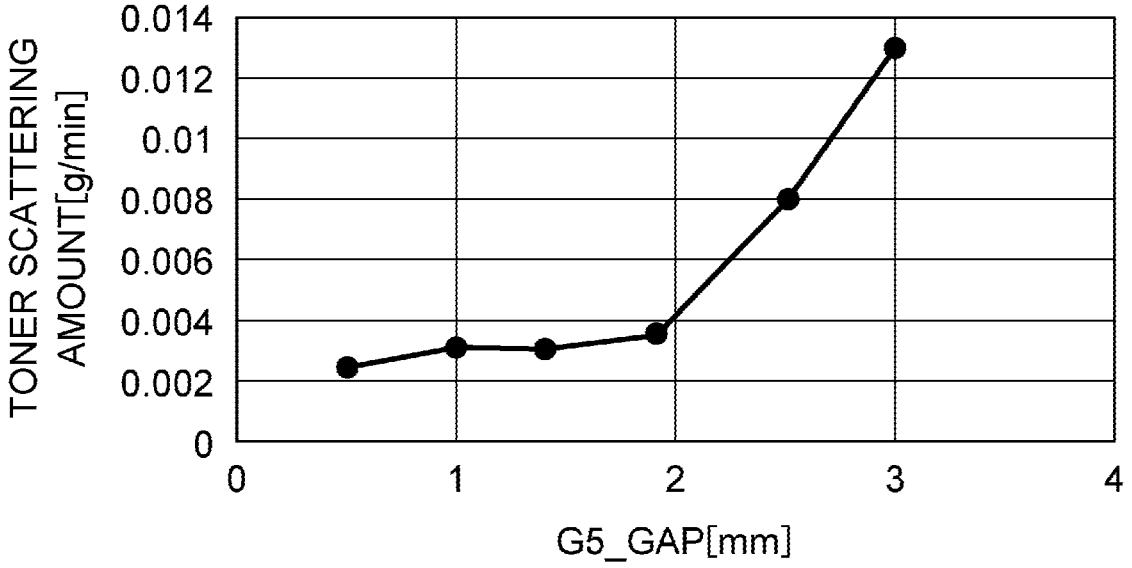
FIG. 37 is a graph showing measurement results.

Toner scattering amounts were measured in relation to varying distances of the fifth gap G5. The toner scattering amount was measured as described above. The measurement results are shown in FIG. 37. According to the results, the toner scattering amount is noticeably reduced where the fifth gap G5 is equal to or less than 2 mm. It is conceived that this is because an air flow is appropriately formed in the fifth gap G5. Based on this result, the fifth gap G5 may be equal to or less than 2 mm.

The first gap G1 may be equal to or greater than 0.5 mm and equal to or less than 0.9 mm (e.g. the first gap G1 may be between 0.5 mm and 0.9 mm, inclusive), in order to appropriately set the air volume of the air flow flowing through the first gap G1 and allow the air to be sufficiently suctioned from the first gap G1 to the container 21. In addition, it is possible to suppress a reverse flow of the air in the first gap G1, in order to suppress toner scattering.

Figure 38:
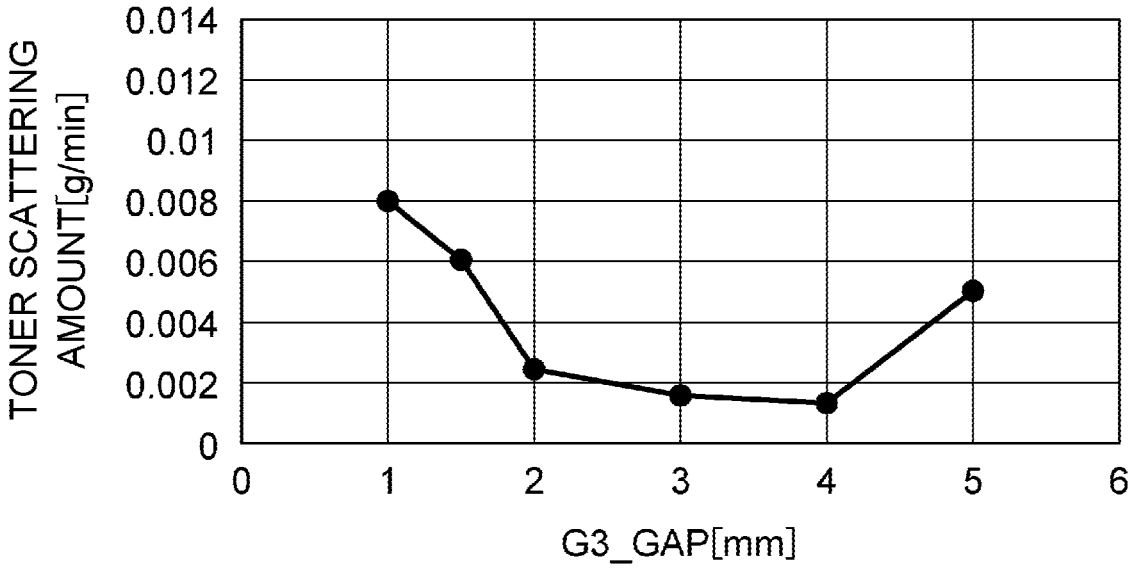
FIG. 38 is a graph showing measurement results.

Toner scattering amounts were measured in relation to varying distances of the third gap G3. The toner scattering amount was measured as described above. The measurement results are shown in FIG. 38. According to the results, the toner scattering amount is noticeably reduced where the third gap G3 is equal to or greater than 2 mm and equal to or less than 4 mm (e.g. where the third gap G3 is between 2 mm and 4 mm, inclusive). It is conceived that this is because an air flow is suitably formed in the third gap G3, and most of this air flow can flow to the second gap G2. Based on these results, the third gap G3 may be equal to or greater than 2 mm and equal to or less than 4 mm (or between 2 mm and 4 mm, inclusive). Here, a gap between the container 21 and the developer retainer 26, downstream of the third gap G3 is set as a sixth gap G6. In this example, the sixth gap G6 may be less than the third gap G3. In examples where the sixth gap G6 is less than the third gap G3, the flow velocity of the air flow increases once before reaching the third gap G3, and then decreases in the third gap G3. Consequently, since a pressure loss of the air flow is generated, it is possible to suppress the flow velocity of this air flow from becoming excessive and to allow most of this air flow to flow to the second gap G2.

Figure 39:
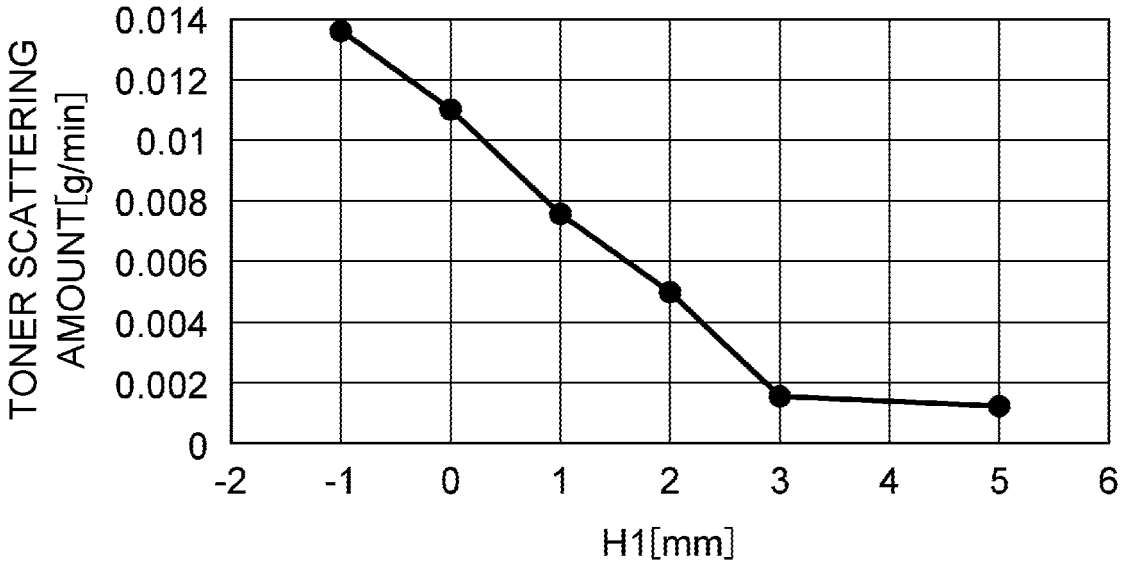
FIG. 39 is a graph showing measurement results.

Toner scattering amounts were measured in relation to varying measures of height H1. With reference to FIG. 29, the height H1 refers to a vertical height between a position P1 and a vertex P2 of the developer retainer 26 in the vertical direction, and the position P1 refers to a position in the container 21 inward of the first gap G1 where the container 21 and the developer carrier 24 are closest to each other. The toner scattering amount was measured as described above. The measurement results are shown in FIG. 39. According to the results, the toner scattering amount is noticeably reduced where the height H1 is equal to or greater than 3 mm. It is conceived that this is because the flow passage of the air flow directed from the inside of the container 21 to the third gap G3 forms a suitable crank shape, so that a pressure loss is suitably generated in the air flow of the third gap G3. Consequently, the air flow is prevented from reaching an excessive flow velocity, such that most of this air flow can flow to the second gap G2. Based on these results, the height H1 may be equal to or greater than 3 mm.

It is to be understood that not all aspects, advantages and features described herein may necessarily be achieved by, or included in, any one particular example. Indeed, having described and illustrated various examples herein, it should be apparent that other examples may be modified in arrangement and detail. For example, in the example developing devices of FIGS. 29 to 34, the first gap G1 is not necessarily less than both the second gap G2 and the third gap G3.

The aforementioned examples and/or features thereof may be expressed, entirely or partially, by the following example features, without being limited thereto.

Disclosed herein is an image forming system comprising: an image carrier to rotate; a developer carrier to rotate; a container to contain the developer carrier; and a developer retainer separated from the developer carrier by a first gap of closest proximity, separated from the image carrier by a second gap of closest proximity, and separated from the container by a third gap of closest proximity, in which the first gap is less than the second gap and the third gap.

The second gap may be equal to or less than the third gap.

The container may have a filter configured to ventilate the container and obstruct passing of the developer.

The developer carrier may extend along an axial line and have a developer carrying region to carry the developer, and a length of the developer carrying region along a direction of the axial line of the developer carrier may be equal to or longer than a length of the third gap in the direction of the axial line.

The developer carrier may extend along an axial line, and the third gap between the container and the developer retainer may be associated with a cross-sectional area that is tapered to be narrower toward the image carrier in a direction of the axial line, by a baffle plate.

A cross-sectional area associated with the first gap may be less than a cross-sectional area associated with the third gap.

The image forming system may further include a brush located in the container at the third gap to extend toward the developer retainer.

The brush may extend from the container downward in a vertical direction.

The brush may have a plurality of rods extending toward the developer retainer, and the plurality of rods may be arranged in a staggered manner.

The developer retainer may be rotatable.

The developer retainer may have a cleaning member arranged such that at least a part of the brush is located on a rotation locus of the cleaning member.

The image forming system may further include a guide member located in the container, wherein the guide member extends to the second gap between the developer retainer and the image carrier.

The guide member may be detachably installed in the container.

The guide member may be elastically deformable and positioned to abut with the developer retainer.

Disclosed herein is an image forming system comprising: an image carrier having a surface to form an electrostatic latent image; a developer carrier to rotate, the developer carrier being spaced apart from the image carrier and having a surface to carry a developer; a container to contain the developer and the developer carrier; and a developer retainer forming an air circulation path to return the developer discharged from the container back to the container between the developer carrier, the image carrier, and the container, in which a closest distance between the developer carrier and the developer retainer is shorter than a closest distance between the developer carrier and the developer retainer, and shorter than a closest distance between the container and the developer retainer.

While the disclosure has been shown and described with reference to examples thereof, they are provided for illustration and it will be understood that various modifications and equivalent other examples may be made from the disclosure. Accordingly, the scope of the disclosure is defined by the appended claims.

What is claimed is:

1. An image forming system, comprising:

a rotatable image carrier;

a rotatable developer carrier;

a container to contain the developer carrier; and a rod-shaped developer retainer, disposed between the image carrier and the developer carrier, separated from the developer carrier by a first gap of closest proximity, separated from the image carrier by a second gap of closest proximity, and separated from the container by a third gap of closest proximity, wherein the first gap is less than the second gap and the third gap.

2. The image forming system according to claim 1, wherein the second gap is equal to or less than the third gap.

3. The image forming system according to claim 1, wherein the container has a filter to ventilate the container and obstruct passing of the developer.

4. The image forming system according to claim 1, wherein the developer carrier extends along an axial line and has a developer carrying region to carry the developer, and a length of the developer carrying region along a direction of the axial line of the developer carrier is equal to or longer than a length of the third gap in the direction of the axial line.

5. The image forming system according to claim 1, wherein the developer carrier extends along an axial line, and the third gap between the container and the developer retainer is associated with a cross-sectional area that is tapered to be narrower toward the image carrier in a direction of the axial line, by a baffle plate.

6. The image forming system according to claim 1, wherein a cross-sectional area associated with the first gap is less than a cross-sectional area associated with the third gap.

7. The image forming system according to claim 1, further comprising a brush located in the container at the third gap to extend toward the developer retainer.

8. The image forming system according to claim 7, wherein the brush extends from the container downward in a vertical direction.

9. The image forming system according to claim 7, wherein the brush has a plurality of rods extending toward the developer retainer, and the plurality of rods are arranged in a staggered manner.

10. The image forming system according to claim 7, wherein the developer retainer is rotatable.

11. The image forming system according to claim 10, wherein the developer retainer has a cleaning member arranged such that at least a part of the brush is located on a rotation locus of the cleaning member.

12. The image forming system according to claim 1, further comprising a guide located in the container, wherein the guide extends to the second gap between the developer retainer and the image carrier.

13. The image forming system according to claim 12, wherein the guide is detachably installed in the container.

14. The image forming system according to claim 12, wherein the guide is elastically deformable and positioned to abut with the developer retainer.

15. An image forming system, comprising:

an image carrier having a surface to form an electrostatic latent image;

a rotatable developer carrier, the developer carrier being spaced apart from the image carrier and having a surface to carry a developer;

a container to contain the developer and the developer carrier; and a rod-shaped developer retainer, disposed between the image carrier and the developer carrier, forming an air circulation path to return the developer discharged from the container back to the container between the developer carrier, the image carrier, and the container, wherein a closest distance between the developer carrier and the developer retainer is shorter than a closest distance between the developer carrier and the developer retainer, and shorter than a closest distance between the container and the developer retainer.

* * * * *